US008159515B2

(12) United States Patent
Makino

(10) Patent No.: US 8,159,515 B2
(45) Date of Patent: Apr. 17, 2012

(54) IMAGE FORMING APPARATUS

(75) Inventor: Daisuke Makino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 12/541,771

(22) Filed: Aug. 14, 2009

(65) Prior Publication Data

US 2010/0040390 A1 Feb. 18, 2010

(30) Foreign Application Priority Data

Aug. 18, 2008 (JP) ..... 2008-209966
Jul. 15, 2009 (JP) ..... 2009-166908

(51) Int. Cl.
*B41J 2/435* (2006.01)

(52) U.S. Cl. ..... 347/234

(58) Field of Classification Search ..... 347/234
See application file for complete search history.

(56) References Cited

U.S. PATENT DOCUMENTS 4,794,413 A * 12/1988 Yamazaki et al. ..... 347/247
5,839,013 A * 11/1998 Murasawa et al. ..... 399/15
6,795,099 B2 9/2004 Koga
2003/0156180 A1 * 8/2003 Koga et al. ..... 347/129

FOREIGN PATENT DOCUMENTS

JP 06-019279 * 1/1994
JP 8-130626 A 5/1996
JP 2002-372798 * 12/2002
JP 2004-223716 A 8/2004
JP 2005-66827 A 3/2005
JP 2005-202078 A 7/2005

* cited by examiner

*Primary Examiner* — Charlie Peng
(74) *Attorney, Agent, or Firm* — Canon U.S.A., Inc. IP Division

(57) ABSTRACT

An image forming apparatus includes an image forming unit, an exposure unit, a detection unit, a storage unit, and a control unit. The image forming unit includes a photosensitive member on which an electrostatic latent image is formed. The exposure unit exposes the photosensitive member. The detection unit detects that a reference position disposed on the photosensitive member has reached a predetermined position. The storage unit stores correction data for correcting unevenness of potential characteristic in the photosensitive member. The control unit controls an exposure intensity of the exposure unit at each position on the photosensitive member based on the correction data.

10 Claims, 24 Drawing Sheets

FIG.5A

| | | MAIN SCANNING DIRECTION | | | | | | | | |
|---|---|---|---|---|---|---|---|---|---|---|
| | | -150 | ··· | -60 | -30 | 0 | 30 | 60 | ··· | 150 |
| SUB-SCANNING DIRECTION | 0 | $E_{-150,0}$ | ··· | $E_{-150,0}$ | $E_{-30,0}$ | $E_{0,0}$ | $E_{30,0}$ | $E_{60,0}$ | ··· | $E_{150,0}$ |
| | 10 | $E_{-150,10}$ | ··· | $E_{-60,10}$ | $E_{-30,10}$ | $E_{0,10}$ | $E_{30,10}$ | $E_{60,10}$ | ··· | $E_{150,10}$ |
| | 20 | $E_{-150,20}$ | ··· | $E_{-60,20}$ | $E_{-30,20}$ | $E_{0,20}$ | $E_{30,20}$ | $E_{60,20}$ | ··· | $E_{150,20}$ |
| | 30 | $E_{-150,30}$ | ··· | $E_{-60,30}$ | $E_{-30,30}$ | $E_{0,30}$ | $E_{30,30}$ | $E_{60,30}$ | ··· | $E_{150,30}$ |
| | ⋮ | ⋮ | ··· | ··· | ··· | ··· | ··· | ··· | ··· | ⋮ |
| | 360 | $E_{-150,360}$ | ··· | $E_{-60,30}$ | $E_{-30,360}$ | $E_{0,360}$ | $E_{30,360}$ | $E_{60,360}$ | ··· | $E_{-150,0}$ |

MEASURED POTENTIAL CHARACTERISTIC COMPONENT ··· Eij
(i: COMPONENT IN MAIN SCANNING DIRECTION, j: COMPONENT IN SUB-SCANNING DIRECTION)

WHETHER TO CORRECT UNEVENNESS IN MAIN SCANNING DIRECTION CAN BE DESIGNATED IN OPERATION UNIT

FIG.10A

| SUB-SCANNING DIRECTION (° FROM HOME POSITION OF PHOTOSENSITIVE MEMBER) | MAIN SCANNING DIRECTION (mm FROM CENTER) | | | | | | | | | | | | | | |
|---|---|---|---|---|---|---|---|---|---|---|---|---|---|---|---|
| | -150 | -140 | -130 | -110 | -90 | -60 | -30 | 0 | 30 | 60 | 90 | 110 | 130 | 140 | 150 |
| 0 | 56 | 56 | 60 | 56 | 62 | 52 | 49 | 47 | 39 | 39 | 44 | 45 | 42 | 40 | 40 |
| 10 | 57 | 57 | 62 | 57 | 62 | 51 | 49 | 46 | 40 | 40 | 44 | 45 | 41 | 41 | 39 |
| 20 | 56 | 60 | 62 | 59 | 60 | 51 | 50 | 49 | 41 | 44 | 45 | 47 | 43 | 42 | 39 |
| 30 | 55 | 60 | 61 | 60 | 58 | 52 | 51 | 48 | 40 | 43 | 44 | 46 | 44 | 40 | 39 |
| 40 | 55 | 61 | 60 | 61 | 57 | 53 | 52 | 50 | 41 | 43 | 46 | 44 | 44 | 40 | 41 |
| 50 | 53 | 58 | 58 | 58 | 55 | 52 | 50 | 48 | 38 | 42 | 44 | 42 | 43 | 40 | 41 |
| 60 | 54 | 56 | 58 | 58 | 56 | 54 | 52 | 47 | 40 | 44 | 45 | 41 | 46 | 41 | 42 |
| 70 | 54 | 54 | 57 | 57 | 54 | 54 | 51 | 47 | 39 | 42 | 44 | 40 | 43 | 39 | 40 |
| 80 | 54 | 53 | 56 | 58 | 56 | 54 | 53 | 50 | 40 | 41 | 44 | 43 | 42 | 40 | 38 |
| 90 | 51 | 51 | 51 | 57 | 56 | 54 | 51 | 49 | 39 | 40 | 42 | 41 | 40 | 39 | 37 |
| 100 | 48 | 49 | 51 | 55 | 54 | 54 | 48 | 47 | 38 | 39 | 41 | 39 | 38 | 39 | 35 |
| 110 | 48 | 49 | 50 | 53 | 53 | 54 | 47 | 47 | 36 | 38 | 39 | 39 | 37 | 40 | 35 |
| 120 | 48 | 48 | 49 | 52 | 53 | 54 | 46 | 45 | 36 | 38 | 39 | 38 | 38 | 37 | 34 |
| 130 | 46 | 49 | 51 | 54 | 56 | 54 | 49 | 46 | 39 | 41 | 41 | 39 | 40 | 36 | 36 |
| 140 | 43 | 49 | 51 | 53 | 55 | 51 | 50 | 47 | 39 | 40 | 41 | 39 | 38 | 36 | 34 |
| 150 | 44 | 48 | 51 | 54 | 54 | 52 | 50 | 48 | 40 | 42 | 42 | 40 | 38 | 38 | 36 |
| 160 | 41 | 46 | 49 | 51 | 53 | 51 | 48 | 47 | 39 | 40 | 41 | 37 | 37 | 36 | 35 |
| 170 | 42 | 46 | 48 | 52 | 52 | 50 | 48 | 49 | 40 | 42 | 43 | 37 | 38 | 36 | 38 |
| 180 | 42 | 46 | 45 | 51 | 50 | 49 | 47 | 48 | 39 | 41 | 41 | 38 | 36 | 38 | 37 |
| 190 | 42 | 45 | 45 | 50 | 52 | 50 | 48 | 48 | 40 | 41 | 42 | 39 | 37 | 39 | 36 |
| 200 | 44 | 45 | 46 | 50 | 53 | 52 | 50 | 49 | 40 | 42 | 40 | 40 | 37 | 35 | 35 |
| 210 | 45 | 47 | 47 | 50 | 53 | 53 | 51 | 48 | 42 | 40 | 41 | 39 | 36 | 36 | 36 |
| 220 | 45 | 50 | 50 | 52 | 56 | 54 | 51 | 50 | 45 | 42 | 44 | 42 | 38 | 40 | 37 |
| 230 | 48 | 51 | 52 | 53 | 57 | 56 | 52 | 51 | 46 | 44 | 45 | 43 | 42 | 39 | 38 |
| 240 | 53 | 55 | 55 | 58 | 62 | 61 | 58 | 54 | 49 | 50 | 49 | 45 | 45 | 42 | 39 |
| 250 | 55 | 58 | 57 | 61 | 63 | 60 | 59 | 54 | 47 | 48 | 48 | 44 | 44 | 42 | 39 |
| 260 | 57 | 62 | 61 | 61 | 65 | 61 | 61 | 56 | 48 | 49 | 49 | 45 | 45 | 44 | 41 |
| 270 | 56 | 61 | 62 | 61 | 62 | 58 | 58 | 56 | 47 | 48 | 48 | 45 | 43 | 41 | 40 |
| 280 | 56 | 59 | 64 | 63 | 64 | 60 | 57 | 55 | 49 | 48 | 49 | 45 | 44 | 41 | 40 |
| 290 | 54 | 60 | 62 | 62 | 63 | 60 | 55 | 53 | 47 | 48 | 45 | 43 | 42 | 40 | 39 |
| 300 | 55 | 60 | 63 | 63 | 63 | 61 | 56 | 53 | 48 | 49 | 46 | 44 | 43 | 43 | 41 |
| 310 | 56 | 59 | 61 | 62 | 61 | 58 | 54 | 52 | 47 | 47 | 47 | 43 | 44 | 43 | 41 |
| 320 | 56 | 59 | 60 | 61 | 59 | 55 | 52 | 48 | 47 | 45 | 47 | 42 | 43 | 42 | 38 |
| 330 | 56 | 59 | 61 | 60 | 59 | 52 | 51 | 47 | 44 | 44 | 45 | 42 | 42 | 41 | 40 |
| 340 | 55 | 57 | 59 | 59 | 58 | 51 | 50 | 45 | 42 | 43 | 45 | 41 | 41 | 40 | 41 |
| 350 | 57 | 59 | 61 | 60 | 57 | 52 | 50 | 45 | 41 | 43 | 46 | 43 | 44 | 42 | 42 |
| MAIN SCANNING DIRECTION (SUB-SCANNING MEAN) | 51 | 54 | 55 | 57 | 57 | 54 | 52 | 49 | 42 | 43 | 44 | 42 | 41 | 40 | 38 |
| DIFFERENCE FROM OVERALL MEAN | 3.1 | 6.0 | 7.5 | 8.8 | 9.4 | 6.2 | 3.6 | 1.2 | -5.9 | -4.9 | -3.9 | -6.1 | -6.9 | -8.3 | -9.6 |

| OVERALL MEAN |
|---|
| 47.9 |

FIG.11A

| SUB-SCANNING DIRECTION (° FROM HOME POSITION OF PHOTOSENSITIVE MEMBER) | MAIN SCANNING DIRECTION (mm FROM CENTER) | | | | | | | | | | | | | | |
|---|---|---|---|---|---|---|---|---|---|---|---|---|---|---|---|
| | -150 | -140 | -130 | -110 | -90 | -60 | -30 | 0 | 30 | 60 | 90 | 110 | 130 | 140 | 150 |
| 0 | 53 | 51 | 53 | 48 | 54 | 46 | 46 | 46 | 44 | 43 | 48 | 51 | 48 | 47 | 49 |
| 10 | 54 | 52 | 55 | 49 | 54 | 45 | 46 | 45 | 45 | 44 | 48 | 51 | 47 | 48 | 48 |
| 20 | 53 | 55 | 55 | 51 | 52 | 45 | 47 | 48 | 46 | 48 | 49 | 53 | 49 | 49 | 48 |
| 30 | 52 | 55 | 54 | 52 | 50 | 46 | 48 | 47 | 45 | 47 | 48 | 52 | 50 | 47 | 48 |
| 40 | 52 | 56 | 53 | 53 | 49 | 47 | 49 | 49 | 46 | 47 | 50 | 50 | 50 | 47 | 50 |
| 50 | 50 | 53 | 51 | 50 | 47 | 46 | 47 | 47 | 43 | 46 | 48 | 48 | 49 | 47 | 50 |
| 60 | 51 | 51 | 51 | 50 | 48 | 48 | 49 | 46 | 45 | 48 | 49 | 47 | 52 | 48 | 51 |
| 70 | 51 | 49 | 50 | 49 | 46 | 48 | 48 | 46 | 44 | 46 | 48 | 46 | 49 | 46 | 49 |
| 80 | 51 | 48 | 49 | 50 | 48 | 48 | 50 | 49 | 45 | 45 | 48 | 49 | 48 | 47 | 47 |
| 90 | 48 | 46 | 44 | 49 | 48 | 48 | 48 | 48 | 44 | 44 | 46 | 47 | 46 | 46 | 46 |
| 100 | 45 | 44 | 44 | 47 | 46 | 48 | 45 | 46 | 43 | 43 | 45 | 45 | 44 | 46 | 44 |
| 110 | 45 | 44 | 43 | 45 | 45 | 48 | 44 | 46 | 41 | 42 | 43 | 45 | 43 | 47 | 44 |
| 120 | 45 | 43 | 42 | 44 | 45 | 48 | 43 | 44 | 41 | 42 | 43 | 44 | 44 | 44 | 43 |
| 130 | 43 | 44 | 44 | 46 | 48 | 48 | 46 | 45 | 44 | 45 | 45 | 45 | 46 | 43 | 45 |
| 140 | 40 | 44 | 44 | 45 | 47 | 45 | 47 | 46 | 44 | 44 | 45 | 45 | 44 | 43 | 43 |
| 150 | 41 | 43 | 44 | 46 | 46 | 46 | 47 | 47 | 45 | 46 | 46 | 46 | 44 | 45 | 45 |
| 160 | 38 | 41 | 42 | 43 | 45 | 45 | 45 | 46 | 44 | 44 | 45 | 43 | 43 | 43 | 44 |
| 170 | 39 | 41 | 41 | 44 | 44 | 44 | 45 | 48 | 45 | 46 | 47 | 43 | 44 | 43 | 47 |
| 180 | 39 | 41 | 38 | 43 | 42 | 43 | 44 | 47 | 44 | 45 | 45 | 44 | 42 | 45 | 46 |
| 190 | 39 | 40 | 38 | 42 | 44 | 44 | 45 | 47 | 45 | 45 | 46 | 45 | 43 | 46 | 45 |
| 200 | 41 | 40 | 39 | 42 | 45 | 46 | 47 | 48 | 45 | 46 | 44 | 46 | 43 | 42 | 44 |
| 210 | 42 | 42 | 40 | 42 | 45 | 47 | 48 | 47 | 47 | 44 | 45 | 45 | 42 | 43 | 45 |
| 220 | 42 | 45 | 43 | 44 | 48 | 48 | 48 | 49 | 50 | 46 | 48 | 48 | 44 | 47 | 46 |
| 230 | 45 | 46 | 45 | 45 | 49 | 50 | 49 | 50 | 51 | 48 | 49 | 49 | 48 | 46 | 47 |
| 240 | 50 | 50 | 48 | 50 | 54 | 55 | 55 | 53 | 54 | 54 | 53 | 51 | 51 | 49 | 48 |
| 250 | 52 | 53 | 50 | 53 | 55 | 54 | 56 | 53 | 52 | 52 | 52 | 50 | 50 | 49 | 48 |
| 260 | 54 | 57 | 54 | 53 | 57 | 55 | 58 | 55 | 53 | 53 | 53 | 51 | 51 | 51 | 50 |
| 270 | 53 | 56 | 55 | 53 | 54 | 52 | 55 | 55 | 52 | 52 | 52 | 51 | 49 | 48 | 49 |
| 280 | 53 | 54 | 57 | 55 | 56 | 54 | 54 | 54 | 54 | 52 | 53 | 51 | 50 | 48 | 49 |
| 290 | 51 | 55 | 55 | 54 | 55 | 54 | 52 | 52 | 52 | 52 | 49 | 49 | 48 | 47 | 48 |
| 300 | 52 | 55 | 56 | 55 | 55 | 55 | 53 | 52 | 53 | 53 | 50 | 50 | 49 | 50 | 50 |
| 310 | 53 | 54 | 54 | 54 | 53 | 52 | 51 | 51 | 52 | 51 | 51 | 49 | 50 | 50 | 50 |
| 320 | 53 | 54 | 53 | 53 | 51 | 49 | 49 | 47 | 52 | 49 | 51 | 48 | 49 | 49 | 47 |
| 330 | 53 | 54 | 54 | 52 | 51 | 46 | 48 | 46 | 49 | 48 | 49 | 48 | 48 | 48 | 49 |
| 340 | 52 | 52 | 52 | 51 | 50 | 45 | 47 | 44 | 47 | 47 | 49 | 47 | 47 | 47 | 50 |
| 350 | 54 | 54 | 54 | 52 | 49 | 46 | 47 | 44 | 46 | 47 | 50 | 49 | 50 | 49 | 51 |

WHETHER TO CORRECT UNEVENNESS IN MAIN SCANNING DIRECTION CAN BE DESIGNATED IN OPERATION UNIT

WHETHER TO CORRECT UNEVENNESS IN MAIN SCANNING DIRECTION CAN BE DESIGNATED IN OPERATION UNIT

IMAGE FORMING APPARATUS

BACKGROUND OF THE INVENTION

1. Field of the Invention

The present invention relates to an image forming apparatus that forms an image using electrophotographic method.

2. Description of the Related Art

In a conventional image forming apparatus using an electrophotographic method, a charging device charges a surface of a cylindrical image bearing member such as a photosensitive member that is rotatably driven by a rotation shaft. The exposure device in the image forming apparatus then exposes the charged photosensitive member to form an electrostatic latent image on the photosensitive member.

The electrostatic latent image formed on the photosensitive member is developed using toner. At a transfer unit, the developed toner image is transferred to a recording medium directly or via an intermediate transfer member. An image is thus formed on the recording medium. The toner remaining on the photosensitive member when forming the image is removed from the surface of the photosensitive member by a cleaning device including a cleaning blade that is in contact with the photosensitive member.

The film thickness of the photosensitive layer on the surface of the photosensitive member is not uniform at each of the positions in a direction of the rotation shaft and a rotational direction of the photosensitive member. This is due to a production error when the photosensitive member is manufactured.

Further, as the cumulative number of times of image formation becomes large, the film on the photosensitive layer may be scraped off due to the contact with the recording medium or the intermediate transfer member at the transfer unit, or the contact with the cleaning blade. Since the amounts of the photosensitive layer that is scraped off are different depending on the positions where the toner is adhered and where the toner is not adhered on the photosensitive member, the film thickness becomes uneven.

As a result, even when the photosensitive member is uniformly charged by the charging device and exposed by a constant exposure amount, the potential on the surface of the photosensitive member becomes uneven. More specifically, sensitivity to voltage and light on the surface of the photosensitive member slightly differs at each position.

In such a case, density unevenness is generated in the formed image. There are techniques as is described below to correct the density unevenness in the image caused by unevenness of a potential characteristic generated on the surface of the photosensitive member.

Japanese Patent Application Laid-Open No. 2005-66827 discusses storing in the image forming apparatus, surface potential data when charging the photosensitive member or surface potential data acquired from the density data of the solid image output to the recording medium.

When the exposure unit exposes the photosensitive member, exposure intensity is adjusted according to an exposed position based on the above-described surface potential data. The in-plane unevenness of the potential characteristic of the photosensitive member is thus compensated by the exposure amount, as is described below.

FIG. 16 illustrates a potential distribution on the surface of the photosensitive member when the photosensitive member in a conventional image forming apparatus is charged and exposed uniformly.

More specifically, FIG. 16 illustrates the unevenness of the potential characteristic on the surface of the photosensitive member, in the image forming apparatus. Such unevenness is generated when the photosensitive member is charged by the charging device and exposed with a constant amount of light to form an image. A main scanning direction of the photosensitive member (i.e., direction parallel to the rotation shaft of the photosensitive member) is indicated in the shorter direction of the distribution. A sub-scanning direction of the photosensitive member (i.e., a direction perpendicular to the main scanning direction, or a rotational direction of the photosensitive member) is indicated in the longer direction. Further, the potential (V) is indicated in the vertical direction.

The unevenness of the potential characteristic of the photosensitive member is caused by a difference of charging sensitivity at each of the positions on the surface of the photosensitive member when the photosensitive member is charged. Moreover, the unevenness is caused by a difference in the potential drop rate at each of the positions on the surface of the photosensitive member when the photosensitive member is exposed.

FIG. 17 illustrates a potential distribution on the photosensitive member when the photosensitive member is uniformly charged and exposed by a constant amount of light. More specifically, FIG. 17 illustrates the potential distribution on the photosensitive member along one line in a direction of the rotation shaft of the photosensitive member (i.e., main scanning direction). The potential is indicated on the vertical axis, and the position on the surface of the photosensitive member in the main scanning direction is indicated on the horizontal axis.

Referring to FIG. 17, after the photosensitive member is charged and exposed, an appropriate potential of the photosensitive member for forming an image may be 50 V. Therefore, the exposure intensity is controlled to compensate the effect of the unevenness of the potential characteristic generated. The exposure intensity is thus increased at a position where the potential is higher than 50 V and decreased at a position where the potential is lower than 50 V when the photosensitive member is uniformly charged and exposed.

The exposure intensity is controlled when the exposure unit scans and exposes the photosensitive member in the main scanning direction and the rotational direction of the photosensitive member (i.e., the sub-scanning direction). As a result, the unevenness of the potential characteristic generated over the entire periphery of the photosensitive member can be corrected.

Further, when the unevenness of the potential characteristic of the photosensitive member is corrected in the sub-scanning direction by changing the exposure intensity, a rotational phase of the photosensitive member is to be managed. The exposure intensity is thus changed according to the rotational phase. An example of a method for managing the rotational phase of the photosensitive member is to use a known home position sensor.

In such a method, the home position sensor detects a home position of the photosensitive member after a predetermined time has passed from when the photosensitive member starts rotating to form the electrostatic latent image until the rotation is stabilized. The exposure intensity in the sub-scanning direction is then changed according to the rotational phase of the photosensitive member thereon.

The unevenness of the potential as described above is to be corrected before forming an image to acquire a high-quality output image. For example, Japanese Patent Application Laid-Open No. 8-130626 discusses an image forming apparatus including a function for printing an image by adding minute dots to the original image. When the print product is copied, the image forming apparatus determines whether the print product can be copied according to a usage restriction expressed by a pattern formed by the added minute dots.

The added minute dots is to be precisely formed into an image and to uniformly reproduce the minute dots in the image surface, so that information indicated by the minute dots can be stably read when the image is copied. Therefore, if the image is formed without correcting the unevenness of the potential characteristic of the photosensitive member that causes unevenness when reproducing the minute dots on the image surface, the minute dots becomes unreadable.

However, there are some images in which correction of the unevenness of the potential characteristic and forming of a high-quality image are not required. In such a case, when the unevenness of the potential characteristic is corrected in the sub-scanning direction of the exposure unit, i.e., the rotational direction of the photosensitive member, by changing the exposure density, the image forming is started in response to the detection of the home position of the photosensitive drum by the home position sensor.

If the control to correct the unevenness of the potential characteristic according to the rotational position of the photosensitive member is not performed, the image forming apparatus can output an image when a preparation time 1801 elapses, as illustrated in FIG. 18.

The preparation time refers to a time period from the time when an image signal is input while the image forming apparatus is in an off or standby state to the time when the rotation speed of the photosensitive drum, the rotation speed of a rotational polygonal mirror, which deflects laser beams to scan the photosensitive drum for exposing the photosensitive drum, and the fixing temperature of a fixing device reach the respective predetermined values to make the image forming apparatus ready for image forming.

On the other hand, when the unevenness of the potential characteristic, which varies according to the rotational phase of the photosensitive drum, is corrected by changing the exposure intensity, the electrostatic latent image cannot be formed on the photosensitive member, even when the rotation is stabilized, until the home position sensor first detects the home position of the photosensitive member (i.e., time 1802 illustrated in FIG. 18).

The time period from the time when the preparation time elapses to the time when the home position sensor first detects the home position of the photosensitive member is equal to the time period used for one rotation of the photosensitive member at a maximum. As a result, a first print output time increases if the unevenness of the potential characteristic in the sub-scanning direction is corrected when forming an image in which high quality is not required. More specifically, the length of time increases between the start of forming an image and the time when the first sheet is discharged, on which an image is formed.

SUMMARY OF THE INVENTION

According to an aspect of the present invention, an image forming apparatus which forms an image on a recording medium in of a first image forming mode and a second image forming mode. The image forming apparatus includes an image forming unit, an exposure unit, a detection unit, a storage unit, and a control unit. The image forming unit includes a photosensitive member on which an electrostatic latent image is formed. The exposure unit is configured to expose the photosensitive member, and to form an image by transferring to the recording medium a toner image acquired by developing the electrostatic latent image formed on the sensitive member using toner. The detection unit is configured to detect that a reference position disposed on the photosensitive member has reached a predetermined position. The storage unit is configured to store correction data for correcting unevenness of potential characteristics of the photosensitive member, and a control unit configured to change the exposure intensity of the exposure unit at each position on the photosensitive member based on the correction data, wherein in a case in which the image forming unit forms an image in the first image forming mode, the control unit allows the exposure unit to start exposing the photosensitive member regardless of a detection of the reference position, wherein in a case in which the image forming unit forms an image in the second image forming mode, the control unit allows the exposure unit to start exposing the photosensitive member in response to a detection of the reference position, and controls the exposure intensity based on the correction data.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5A is a table illustrating data stored in a memory for storing data on the unevenness of the potential characteristic of the photosensitive member in the image forming apparatus.

FIG. 10A is a table illustrating the data (retrieved data) on the potential characteristic of the photosensitive member when the unevenness of the potential characteristic of the photosensitive member is not corrected using the exposure intensity of the exposure unit.

FIG. 11A is a table illustrating the data on the potential characteristic of the photosensitive member (data after correcting the unevenness in the main scanning direction) when the unevenness of the potential characteristic of the photosensitive member is corrected using the exposure intensity of the exposure unit by changing the exposure intensity only in the main scanning direction and not in the sub-scanning direction.

DETAILED DESCRIPTION OF THE EMBODIMENTS

Various exemplary embodiments, features, and aspects of the invention will be described in detail below with reference to the drawings.

Figure 1:
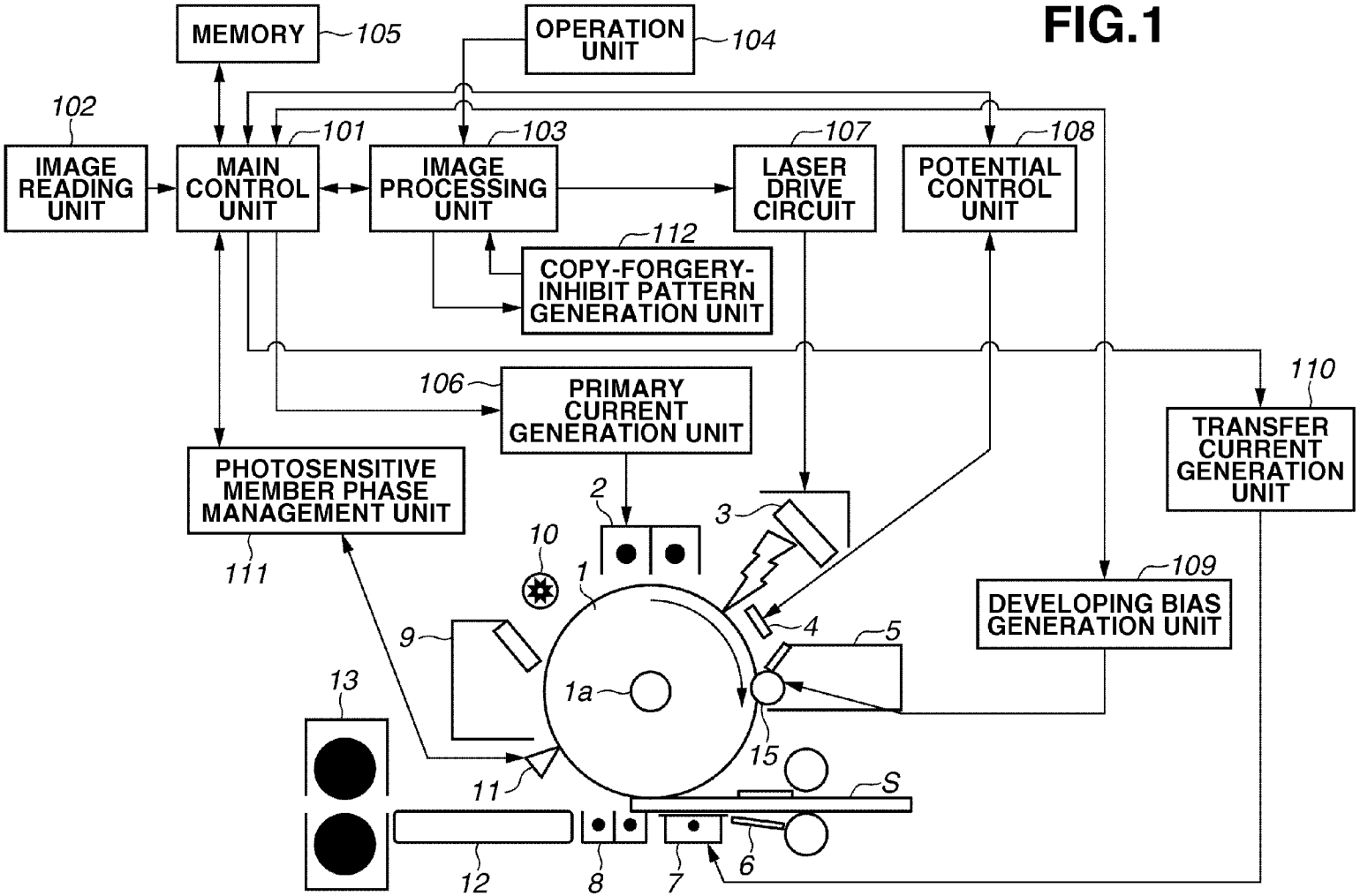
FIG. 1 illustrates a configuration of the image forming apparatus according to a first exemplary embodiment of the present invention.

FIG. 1 illustrates a configuration of an image forming apparatus according to a first exemplary embodiment of the present invention. The configuration illustrated in FIG. 1 is an example for realizing the exposure unit, a correction unit, a control unit, a detection unit, a management unit, an image reading unit, and an addition unit of the present invention.

Referring to FIG. 1, the image forming apparatus includes an image forming unit. The image forming unit includes a photosensitive member 1 (i.e., the image bearing member), a primary charging device 2, an exposure unit 3, a potential sensor 4, a developing device 5, a transfer device 7, a separation charging device 8, a cleaning unit 9, a pre-exposure unit 10, and a photosensitive member home position sensor 11 (i.e., the detection unit).

Further, the image forming apparatus includes a main control unit 101 (i.e., the correction unit and the control unit), an image reading unit 102 (i.e., the image reading unit), an image processing unit 103, an operation unit 104, a memory 105 for storing data on the unevenness of the photosensitive member, a primary current generation unit 106, and a laser drive circuit 107.

Furthermore, the image forming apparatus includes a potential control unit 108, a developing bias generation unit 109, a transfer current generation unit 110, a photosensitive member phase management unit 111, a copy-forgery-prohibit pattern generation unit 112 (i.e., the addition unit), a conveyance registration unit 6, a conveyance unit 12, and a fixing device 13.

The photosensitive member 1 is a cylindrical member, on the surface of which the electrostatic latent image is formed. The photosensitive member 1 is rotatably driven via a rotation shaft la by a mechanism including a direct current (DC) motor (not illustrated). The above-described primary charging device 2, exposure unit 3, potential sensor 4, developing device 5, transfer device 7, separation charging device 8, cleaning unit 9, and pre-image forming exposure unit 10 are disposed in a clockwise direction around the periphery of the photosensitive member 1. The primary charging device 2 charges the photosensitive member 1 using the primary current generated by the primary current generation unit 106.

The exposure unit 3 is disposed in parallel along the main scanning direction of the photosensitive member 1 (i.e., in a direction parallel to the rotation shaft 1*a* of the photosensitive member 1). The exposure unit 3 is driven by the laser drive circuit 107 and exposes the photosensitive member 1 according to an image read from an original document by the image reading unit 102.

The potential sensor 4 measures the potential of the photosensitive member 1 and is movable in the main scanning direction of the photosensitive member 1. The developing device 5 forms a toner image (a visible image) by developing the electrostatic latent image on the photosensitive member 1 using the toner. The transfer device 7 transfers the toner image formed on the photosensitive member 1 to a transfer material such as paper.

The separation charging device 8 separates the transfer material from the photosensitive member 1. The photosensitive member home position sensor 11 included in the photosensitive member 1 detects the home position (fixed position) of the photosensitive member 1 (i.e., detects the rotational phase of the photosensitive member 1). The cleaning unit 9 removes the toner remaining on the photosensitive member 1 after the image is formed. The pre-exposure unit 10 exposes the photosensitive member 1 before forming the image.

The main control unit 101 controls the entire image forming apparatus and performs various processes describe below including the processes illustrated in the flowcharts of FIG. 4A and FIG. 9, based on control programs.

The image reading unit 102 reads the image from the original document, and the image processing unit 103 performs image processing on the image data read from the original document by the image reading unit 102. The operation unit 104 is used by a user to specify various settings to the image forming apparatus and to operate the image forming apparatus.

The memory 105 (i.e., the storage unit) stores correction data for correcting the unevenness of the potential characteristic at each position on the surface of the photosensitive member 1. The intensity of light (exposure intensity) emitted from the exposure unit 3 is changed for correcting thereof. As illustrated in FIG. 5A, the correction data is stored for each position on the surface of the photosensitive member 1 defined in the main scanning direction and the sub-scanning direction (i.e., matrix data). The correction data is stored before shipping in the memory 105, which is determined based on the unevenness of the potential characteristics. The correction data may be updated according to the operating time, the number of sheets on which images are formed, or the like.

The primary current generation unit 106 generates and supplies to the primary charging device 2 the primary current. The laser drive circuit 107 drives the exposure unit 3 to irradiate the photosensitive member 1 with the laser beam. The potential control unit 108 controls the potential based on the potential of the photosensitive member 1 measured by the potential sensor 4.

The developing bias generation unit 109 generates and applies on a developer bearing member 15 of the developing device 5 a developing bias voltage. The transfer current generation unit 110 generates and supplies to the transfer device 7 the transfer current.

The photosensitive member phase management unit 111 manages the rotational phase of the photosensitive member 1 based on the home position of the photosensitive member 1 detected by the photosensitive member home position sensor 11. The copy-forgery-prohibit pattern generation unit 112 generates and adds to the image read from the original document the copy-forgery prohibit pattern. A printed product that is copied based on an image read from the original document can thus be determined as a copy product.

The conveyance registration unit (hereinafter referred to as a registration unit) 6 conveys the transfer material to the transfer position. The conveyance unit 12 conveys the transfer material to the fixing device 13 after the transfer. The fixing device 13 fixes the toner image that is transferred to the transfer material.

In the image forming apparatus, the primary charging device 2 charges the surface of the photosensitive member 1. The exposure unit 3 then exposes the photosensitive member 1 according to the image read from the original document by the image reading unit 102. The exposure unit 3 exposes the photosensitive member 1 by scanning laser beams in a direction parallel to the rotation shaft 1*a* of the photosensitive member 1. The exposure unit 3 thus forms the electrostatic latent image on the photosensitive member 1 in synchronization with the rotation of the photosensitive member 1.

The scanning direction of the exposure unit 3, which is parallel to the rotation shaft la of the photosensitive member 1, will be referred to as the main scanning direction. Further, the scanning direction of the exposure unit 3, which is perpendicular to the main scanning direction (i.e., the rotational direction of the photosensitive member 1), will be referred to as the sub-scanning direction. Furthermore, the exposure intensity of the exposure unit 3 can be controlled to cancel the unevenness of the potential characteristic of the photosensitive member 1 as is described below.

The developing device 5 contains a developer including the toner. A positive charge is applied to the toner inside the developing device 5, and the toner is moved towards the surface of the developer bearing member 15 by rotation of an agitating member (not illustrated) disposed inside the developing device 5.

The toner image is developed in a small space between the photosensitive member 1 and the developer bearing member 15. The developing bias generation unit 109 applies the developing bias including an alternating voltage component to improve developing efficiency and to form a toner image with high density and sharpness.

In the present exemplary embodiment, the toner image is formed on the photosensitive member 1 employing a known reverse developing method in the developing device 5 by using the positively-charged photosensitive member 1 and the positively-charged toner.

The potential of the portion where the toner is not adhered on the photosensitive member 1 is about 500 V, and the potential of the portion where the toner is adhered is about 50 V. Further, the alternating component of the developing bias voltage applied on the developer bearing member 15 is about 250 V.

The transfer material conveyance registration unit 6 conveys a transfer material S to the transfer position opposite to the photosensitive member 1. The transfer device 7 uses a corona charging device to transfer the toner image on the photosensitive member 1 to the transfer material S. More specifically, the transfer device 7 discharges electricity with an opposite polarity to the charge of the toner, i.e., a negative charge.

The separation charging device 8 then separates from the photosensitive member 1 the transfer material S on which the toner image is transferred. The transfer material S is conveyed to the fixing device 13, which heat-fixes the toner image on the transfer material S. The transfer material S is discharged from a discharge unit (not illustrated) to the outside of the image forming apparatus.

The image forming apparatus according to the present exemplary embodiment corrects the unevenness of the potential characteristic of the photosensitive member 1 by changing the exposure intensity of the exposure unit 3 according to the rotational phase of the photosensitive member 1. As a result, the unevenness of the potential characteristic of the photosensitive member 1 when forming an image can be corrected in at least the rotational direction of the photosensitive member 1 (i.e., the sub-scanning direction of the exposure unit 3).

Further, the image forming apparatus according to the present exemplary embodiment selects one of two modes based on conditions for correcting the unevenness of the potential characteristic of the photosensitive member 1 in the rotational direction of the photosensitive member 1. More specifically, the image forming process is switched between a first image forming mode and a second image forming mode. An image with higher quality is formed in the second image forming mode as compared to the first image forming mode.

In the first image forming mode, the exposure intensity is changed in the main scanning direction and not in the sub-scanning direction. In other words, the exposure intensity in the sub-scanning direction at a specific position in the main scanning direction is constant.

On the other hand, in the second image forming mode, the exposure intensity is changed in the main scanning direction and the sub-scanning direction based on matrix image data.

The first image forming mode is selected by the user, for example, when printing a document including only characters. The second image forming mode is selected by the user, for example, when printing an image including a photograph, or outputting an image in which the copy-forgery-prohibit pattern is added to the original document to prohibit copy forgery of the document. The second image forming mode can form an image with higher resolution than the resolution of the first image forming mode. An example in which the copy-forgery-prohibit pattern is added to the document image will be described below in the present exemplary embodiment.

Figure 8:
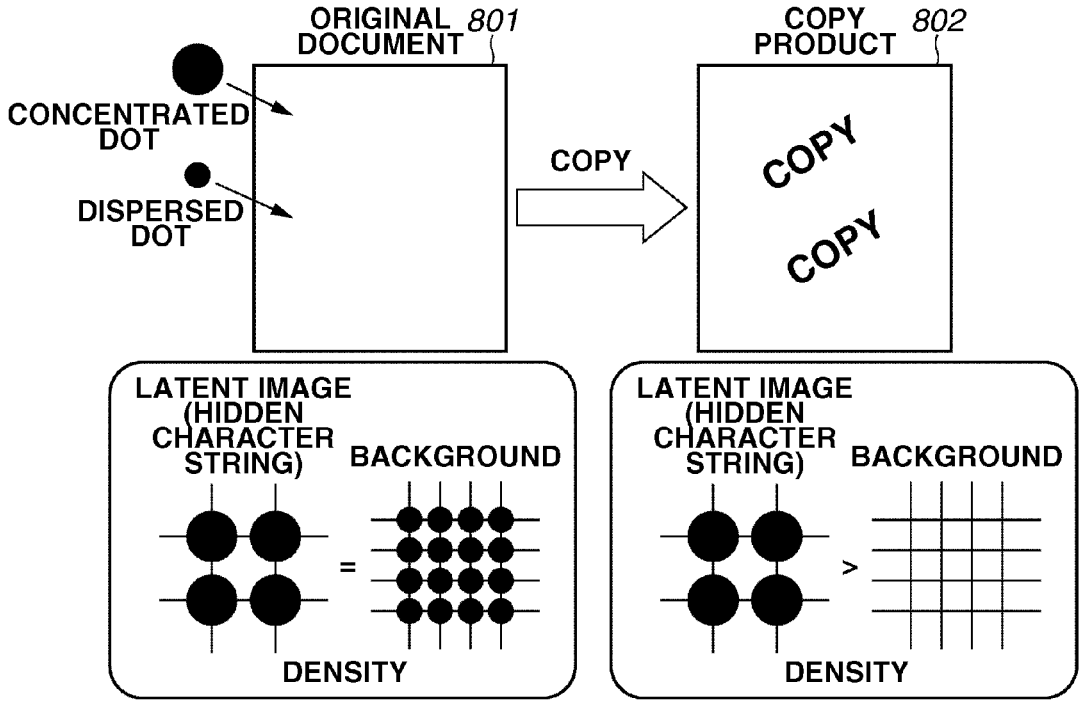
FIG. 8 schematically illustrates a principle of the copy-forgery-inhibited pattern (a watermark pattern, a background pattern).

The copy-forgery-prohibit pattern will be described below with reference to FIG. 8. FIG. 8 is a schematic diagram illustrating the principle of the copy-forgery-prohibit pattern.

Referring to FIG. 8, a copy-forgery-prohibit pattern image includes two regions of approximately the same density. In one region, the dots remain in a copy product 802 after copying an original document 801. In the other region, the dots disappear from the copy product 802 after copying the original document 801. From a macroscopic perspective, a character string such as "COPY" or an image is not visible as they are hidden in the two regions. However, each region has a different characteristic from a microscopic perspective.

The above-described hidden character string or image is referred to as a latent image, and a region around the latent image in which the dots disappear after copying is referred to as a background. The latent image such as the copy-forgery-inhibited pattern is different from the "electrostatic latent image" formed on the surface of the photosensitive member when the photosensitive member is exposed.

The region in which the dots remain after copying (to be referred to as a latent image portion) includes large dots in which individual dots are concentrated. The region in which the dots disappear after copying (to be referred to as a background portion) includes dispersed dots.

As a result, two regions in which the densities are nearly the same and the characteristics are different can be formed. The concentrated dots and the dispersed dots can be generated in the image processing by dot processing using halftone dots of different line numbers, or known dither processing using a dither matrix of different features.

A lower line number dot processing can be used to acquire a concentrated-dots arrangement, and a higher line number dot processing can be used to acquire a dispersed-dots arrangement.

Alternatively, in the dither processing employing the dither matrix, a known dot concentrated type dither matrix can be used to acquire the concentrated-dots arrangement. Further, a dot dispersed type dither matrix can be used to acquire a dispersed-dots arrangement.

Therefore, when the copy-forgery-inhibited pattern image is generated using the above-described dot processing, lower line number dot processing is appropriate for the latent image portion, and the higher line number dot processing is appropriate for the background portion.

Further, when the pattern image is generated using the above-described dither processing, dot concentrated type dither matrix is appropriate for the latent image portion, and the dot dispersed type dither matrix is appropriate for the background portion.

Copying of the image to which the copy-forgery-inhibited pattern is added will be described below.

When a document image is copied using the image reading unit 102 in the image forming apparatus, the image reproducibility is limited. Such image reproducibility depends on an input resolution for reading the minute dots in the original document and an output resolution for reproducing the minute dots of the image forming apparatus.

Therefore, when there is an isolated minute dot that exceeds the image reproducibility of the image forming apparatus, the minute dot cannot be appropriately reproduced in the copy product of the document. The portion of the isolated minute dot thus drops.

More specifically, if the background portion of the copy-forgery-inhibited pattern is created to exceed the limit of the dots reproducible by the image forming apparatus, the large dots (concentrated dots) in the copy-forgery-inhibited pattern can be reproduced by copying. However, the small dots (dispersed dots) cannot be reproduced.

As a result, the hidden image (latent image) pops up in the copy product. Further, the hidden image (latent image) pops up when there is a clear difference between the densities of the dispersed dots and the concentrated dots, even if not all of the dispersed dots disappear by copying.

Therefore, there is a restriction when forming an image to which the above-described copy-forgery-inhibit pattern is added. An acceptable level of the density unevenness in the image becomes strict as compared to when forming an image to which a copy-forgery-inhibit pattern is not added. Such a restriction is placed so that the latent image in the output image becomes less visible and is stably reproduced when the output image is copied.

Further, the copy-forgery-inhibit pattern is used to reproduce the image using dots of different sizes, i.e., the concentrated large dots and dispersed dots, and to reduce the density unevenness in the image. Therefore, when forming the electrostatic latent image on the photosensitive member 1, the hidden image (latent image) of a predetermined dot size as the copy-forgery-inhibit pattern is stably acquired.

Accordingly, the unevenness of the potential characteristic of the photosensitive member 1 is to be corrected when forming an image to which the copy-forgery-inhibit pattern is added.

In the present exemplary embodiment, the method for correcting the unevenness of the potential characteristic of the photosensitive member 1 is changed depending on whether the copy-forgery-inhibit pattern is added to the image to be formed on the transfer material. Whether the correction is to be performed also depends on whether the copy-forgery-inhibit pattern is added to the image.

When the image is to be formed by adding the copy-forgery-inhibit pattern (specific information) to the image data, the unevenness of the potential characteristic is corrected by changing the exposure intensity of the exposure unit 3. The exposure intensity is changed in the main scanning direction and in the rotational direction of the photosensitive member 1 (sub-scanning direction) according to the rotational phase of the photosensitive member 1.

On the other hand, if the image is to be formed without adding the copy-forgery-inhibit pattern, the unevenness of the potential characteristic is not corrected. More specifically, the exposure intensity of the exposure unit 3 is not changed to correct the unevenness of the potential characteristic when forming the image.

Alternatively, if the image is to be formed without adding the copy-forgery-inhibit pattern, the main scanning direction component of the unevenness of the potential characteristic is corrected by changing the exposure intensity of the exposure unit 3. The sub-scanning component of the unevenness of the potential characteristic is not corrected. In the present exemplary embodiment, the copy-forgery-inhibit pattern is formed of minute dots having a diameter of 0.2 mm or less.

The image forming apparatus in the present exemplary embodiment converts the unevenness of the potential characteristic of the photosensitive member 1 into the exposure intensity. The exposure unit 3 in the image forming apparatus then exposes the photosensitive member 1 based on the above-described exposure intensity and the image data read from the document by the image reading unit 102 to correct the unevenness of the potential characteristic. The correction of the unevenness of the potential characteristic will be described below.

The reverse developing method employed in the image forming apparatus will be described below with reference to FIG. 2.

Figure 2:
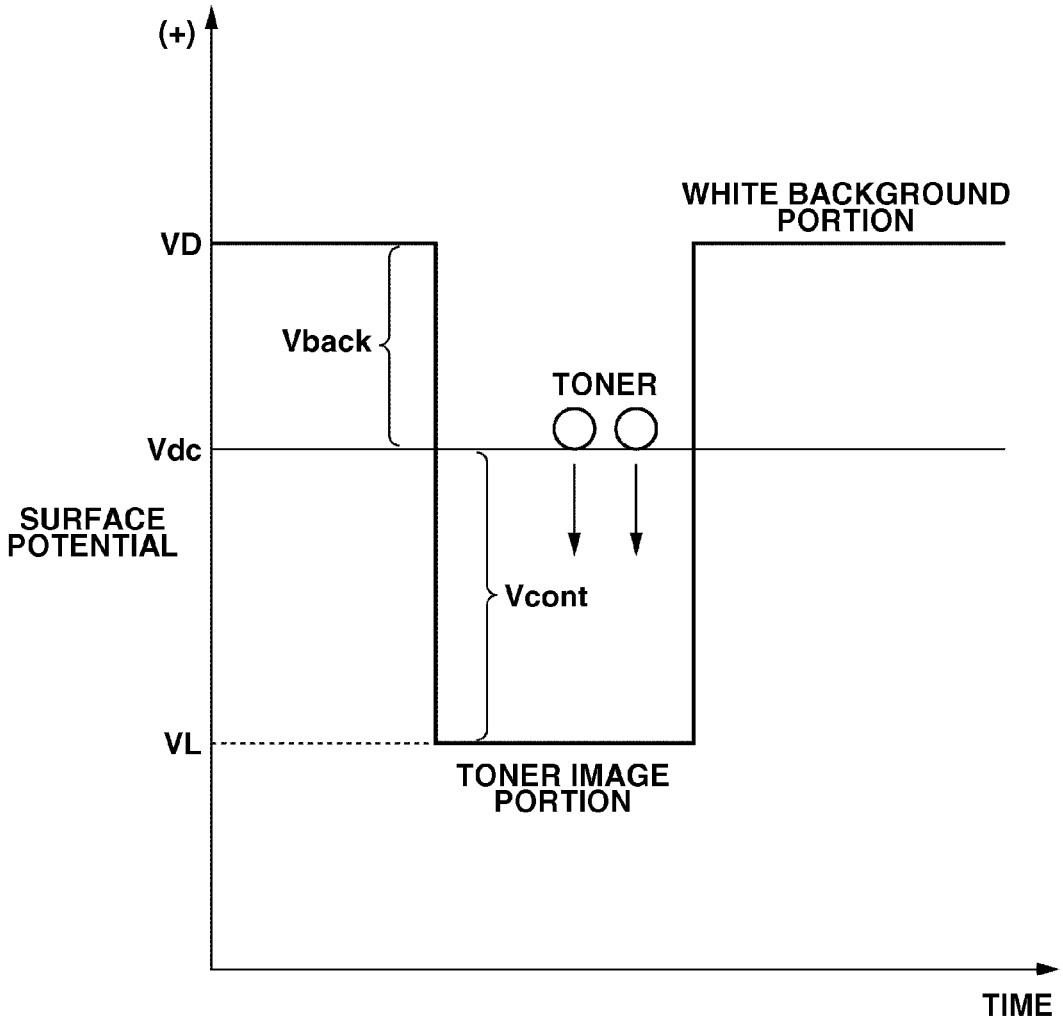
FIG. 2 illustrates a reverse developing method employed in the image forming apparatus.

FIG. 2 illustrates the reverse developing method employed in the image forming apparatus.

Referring to FIG. 2, a charged potential on the surface of the photosensitive member 1 (surface potential) is indicated on the vertical axis, and time is indicated on the horizontal axis. The toner image is formed on a toner image portion 201 of the photosensitive member 1. The potential of the toner image portion 201 becomes VL when the photosensitive member 1 is exposed by the exposure unit 3 after being charged by the primary charging device 2.

Further, the potential of the portion of the photosensitive member 1, which is not exposed by the exposure unit 3 after being charged by the primary charging device 2, becomes VD (potential VL+Vcont+Vback). In the portion of the potential VD, the difference between the potential VD and a developing bias voltage Vdc corresponds to a fog removal voltage when the developing device 5 develops the toner image. A white background portion 202 on the photosensitive member 1 in which the toner image is not formed corresponds to the portion of the potential VD.

In such a case, if sufficient fog removal voltage can be applied to the unevenness of the charged potential of the photosensitive member 1, the unevenness of the charged potential of the photosensitive member 1 becomes ineffective. Therefore, in the present exemplary embodiment, the unevenness of the potential characteristic of the photosensitive member 1 is corrected at the potential VL. More specifically, at the potential VL, the unevenness of the potential characteristic of the photosensitive member 1 when forming an image becomes the unevenness of the toner amount in the toner image developed by the developing device 5 and thus the density unevenness of the image.

Operations of the above-described image forming apparatus according to the present exemplary embodiment will be described below with reference to FIGS. 1 to 11.

The correction data on the planar unevenness of the potential characteristic of the photosensitive member 1 for correcting the unevenness of the potential characteristic of the photosensitive member 1 will be described below with reference to FIGS. 3A and 3B.

Figure 3A:
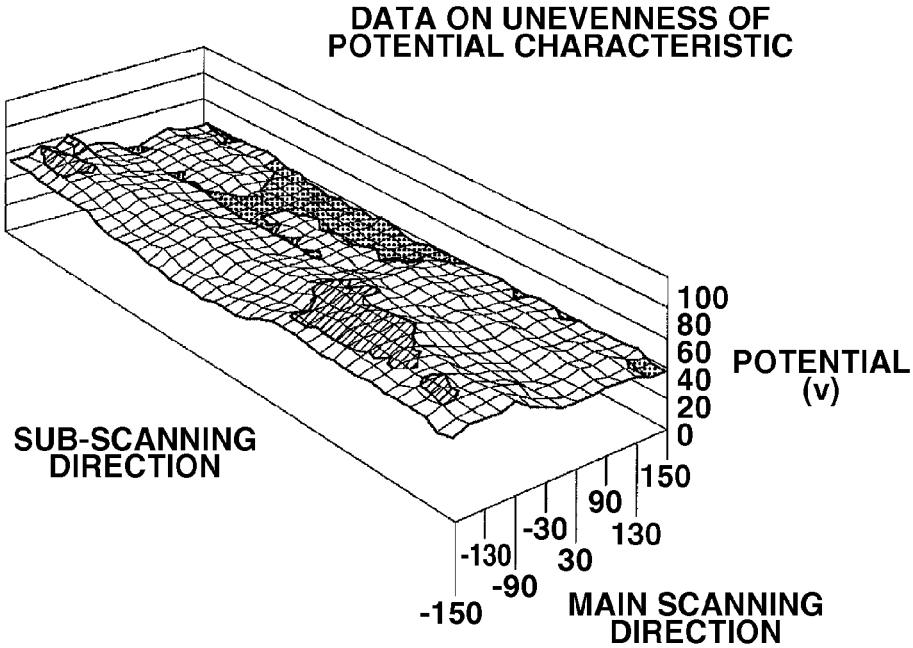
FIG. 3A is a graph illustrating all of retrieved data on the unevenness of the potential characteristic of the photosensitive member in the image forming apparatus.

FIG. 3A illustrates all of the retrieved data on the unevenness of the potential characteristic of the photosensitive member in the image forming apparatus. FIG. 3B is a schematic diagram illustrating data of one line in the main scanning direction of the exposure unit 3 from among the retrieved data illustrated in FIG. 3A.

Figure 3B:
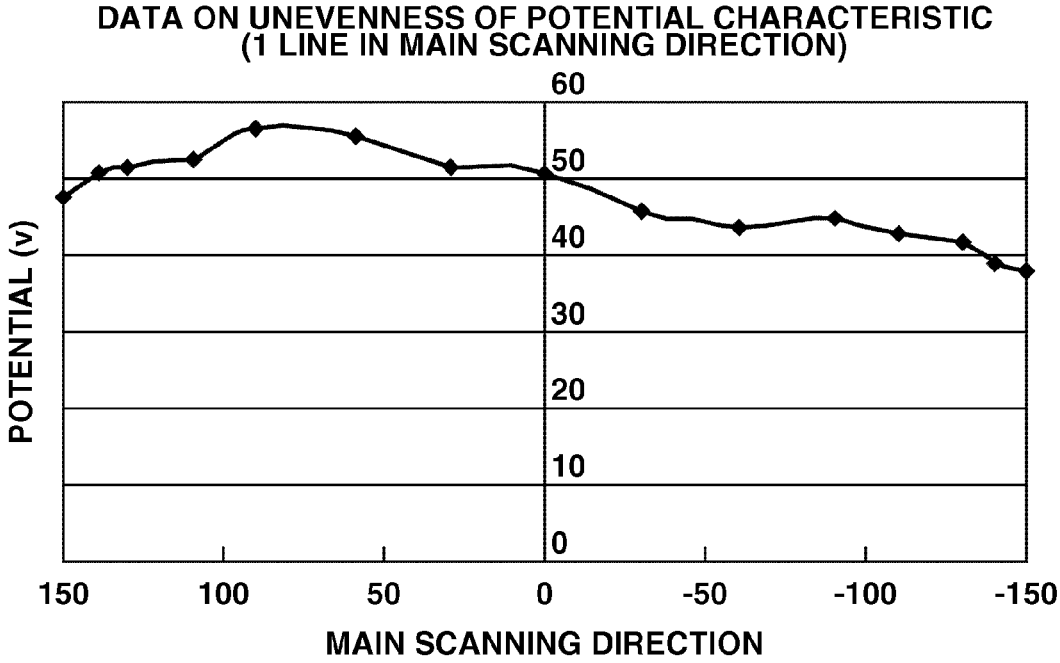
FIG. 3B is a graph schematically illustrating data of one scan line in the main scanning direction of the exposure unit, from among the retrieved data on the unevenness of the potential characteristic.

Referring to FIGS. 3A and 3B, the main control unit 101 illustrated in FIG. 2 previously retrieves in the memory 105 the data on the planar unevenness of the potential characteristic at the potential VL after the photosensitive member 1 is charged and exposed.

In such a case, actual intervals at which the data on the unevenness of the potential characteristic of the photosensitive member 1 is retrieved are determined according to periodicity of the unevenness of the potential characteristic of the photosensitive member 1, the accuracy in correcting the unevenness of the potential characteristic, and the size of the memory 105.

The memory 105 stores the correction data obtained based on the data of the unevenness of the potential characteristic, for example, for every 3 cm in the main scanning direction. Further, the memory 105 stores the correction data for every 10 degrees of the rotational angle of the photosensitive member 1 rotated in the sub-scanning direction.

Furthermore, in the present exemplary embodiment, the image forming apparatus detects the unevenness of potential characteristic of the photosensitive member 1 and stores in the memory 105 the correction data as new correction data obtained based on the detected data. However, the data on the unevenness of the potential characteristic can be previously loaded in the photosensitive member 1 in the manufacturing process.

When the data on the planar unevenness of the potential characteristic of photosensitive member 1 is retrieved, first the charging current of the primary charging device 2 and the exposure intensity of the exposure unit 3 are to be determined. The determined charging current and the exposure intensity become the reference of the data on the unevenness of the potential characteristic. The charging current and the exposure intensity are determined by measuring the potential on the photosensitive member 1 using the potential sensor 4.

The charging current of the primary charging device 2 and the exposure intensity of the exposure unit 3 are adjusted, so that an average value of potentials measured once around in a circumferential direction (sub-scanning direction) at the center of the main scanning direction of the photosensitive member 1 becomes as follows: 500 V as the potential VD after charging the photosensitive member 1, and 50 V as the potential after charging and exposing the photosensitive member 1. The adjustment is made so that such potentials are achieved at a position opposite to the developing device 5 that develops the toner image.

The actual potential VD measured by the potential sensor 4 becomes 520 V and the actual potential VL becomes 65 V as a result of dark decay of the photosensitive member 1.

Figure 4A:
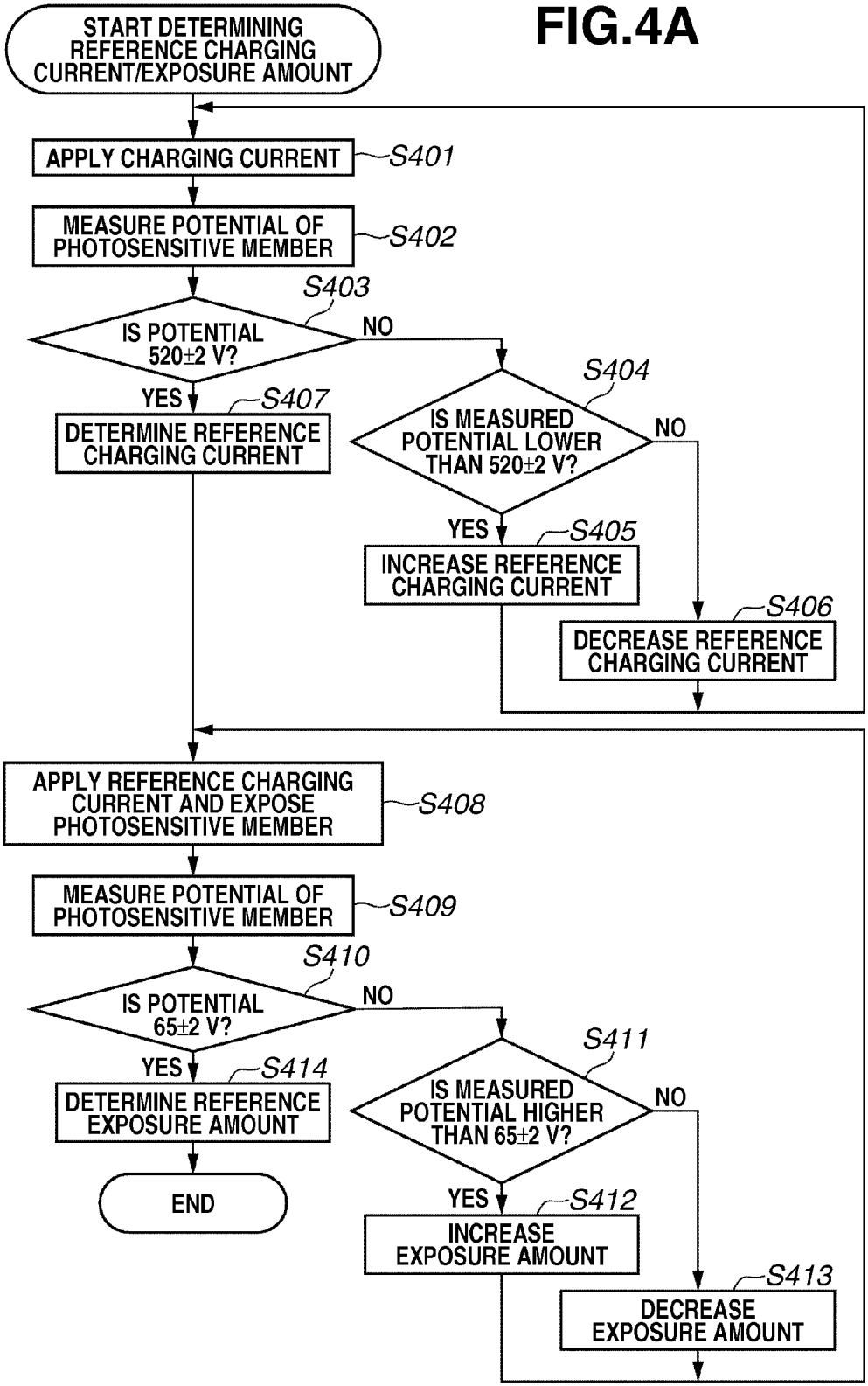
FIG. 4A is a flowchart illustrating a process for determining a reference charging current and a reference exposure amount of the image forming apparatus.
Figure 4B:
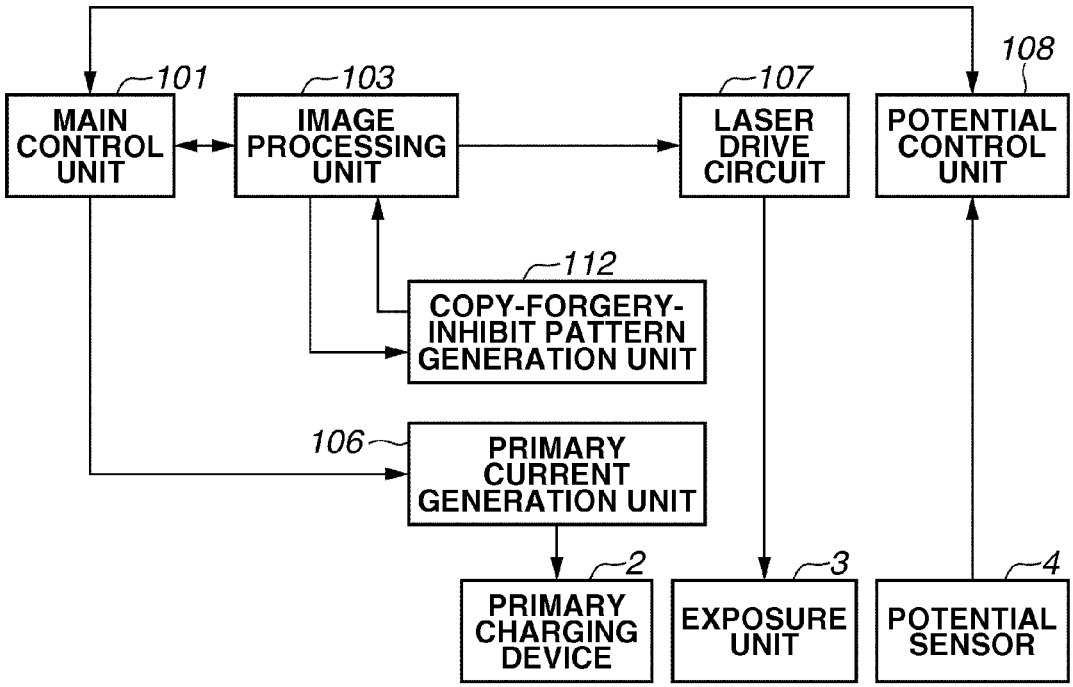
FIG. 4B is a block diagram illustrating a configuration of a control system for determining the reference charging current and the reference exposure amount, extracted from the configuration illustrated in FIG. 1.

FIG. 4A is a flowchart illustrating the process of determining the reference charging current and the reference exposure amount. FIG. 4B is a block diagram illustrating the configuration of the control system for determining the reference charging current and the reference exposure amount, extracted from the configuration of FIG. 1.

Referring to FIG. 4A, in step S401, the main control unit 101 charges the photosensitive member 1 by causing the primary current generation unit 106 to apply the charging current on the primary charging device 2.

In step S402, the potential sensor 4 positioned opposite to the center of the main scanning direction of the photosensitive member 1 measures the potential on the photosensitive member 1. The main control unit 101 then inputs the value measured by the potential sensor 4 via the potential control unit 108.

In step S403, the main control unit 101 determines whether the value measured by the potential sensor 4 is a potential of 520±2 V on an average in the circumferential direction of the photosensitive member 1. If the value measured by the potential sensor 4 is 520±2 V on an average in the circumferential direction of the photosensitive member 1 (YES in step S403), the process proceeds to step S407. On the other hand, if the value is not 520±2 V (NO in step S403), the process proceeds to step S404. In step S404, the main control unit 101 determines whether the value measured by the potential sensor 4 (measured potential) is lower than the potential of 520±2 V.

If the value measured by the potential sensor 4 is lower than 520±2 V (YES in step S404), the process proceeds to step S405. In step S405, the main control unit 101 adjusts the output of the primary current generation unit 106 so that the charging current of the primary charging device 2 is increased. If the measured value is not lower than 520±2 V (NO in step S404), the process proceeds to step S406. In step S406, the main control unit 101 adjusts the output of the primary current generation unit 106 so that the charging current of the primary charging device 2 is decreased.

In step S407, the main control unit 101 determines the reference charging current by determining (adjusting) the output of the primary current generation unit 106. As described above, the main control unit 101 adjusts the output of the primary current generation unit 106 to achieve a potential of 520±2 V on an average in the circumferential direction of the photosensitive member 1 of the photosensitive member 1 as the value measured by the potential sensor 4. Further, the main control unit 101 stores the determined output of the primary current generation unit 106 as the reference charging current in the memory inside the main control unit 101 (not illustrated).

In step S408, after determining the reference charging current, the main control unit 101 causes the primary charging device 2 to charge the photosensitive member 1 based on the reference charging current. Simultaneously, the main control unit 101 performs control to drive the exposure unit 3 using the laser drive circuit 107 to cause the exposure unit 3 to expose the photosensitive member 1 by a constant amount of light.

In step S409, the potential sensor 4 measures the potential of the photosensitive member 1. The main control unit 101 then receives the value measured by the potential sensor 4 via the potential control unit 108.

In step S410, the main control unit 101 determines whether the value measured by the potential sensor 4 is a potential of 65±2 V on an average in the circumferential direction of the photosensitive member 1. If the value measured by the potential sensor 4 is a potential of 65±2 V on an average in the circumferential direction of the photosensitive member 1 (YES in step S410), the process proceeds to step S414.

On the other hand, if the value measured by the potential sensor 4 is not a potential of 65±2 V on an average in the circumferential direction of the photosensitive member 1 (NO in step S410), the process proceeds to step S411. In step S411, the main control unit 101 determines whether the value measured by the potential sensor 4 (measured potential) is higher than the potential of 65±2 V.

If the value measured by the potential sensor 4 is higher than the potential of 65±2 V (YES in step S411), the process proceeds to step S412. In step S412, the main control unit 101 adjusts the output of the laser drive circuit 107 so that the exposure amount of the exposure unit 3 is increased.

On the other hand, if the measured value of the potential sensor 4 is not higher than the potential of 65±2 V (NO in step S411), the process proceeds to step S413. In step S413, the main control unit 101 adjusts the output of the laser drive circuit 107 so that the exposure amount of the exposure unit 3 is decreased. After steps S412 and S413, the process goes back to step S408.

In step S414, the main control unit 101 determines the reference exposure amount. The process is then terminated. The reference exposure amount is determined by determining (adjusting) the output of the laser drive circuit 107 to achieve a potential of 65±2 V on an average in the circumferential direction of the photosensitive member 1 as described above. Further, the main control unit 101 stores in a memory (not illustrated) in the main control unit 101 the output of the laser drive circuit 107 as the reference exposure amount.

The main control unit 101 then uses the determined reference charging current to cause the primary charging device 2 to charge the photosensitive member 1. The main control unit 101 also uses the reference exposure amount (reference exposures intensity) to cause the exposure unit 3 to expose the photosensitive member 1. The main control unit 101 moves the potential sensor 4 in the main scanning direction at 3 cm interval and measures the potential once around in the circumferential direction of the photosensitive member 1 at each main scanning position.

The main control unit 101 calculates the correction data based on the values measured by the potential sensor 4 and stores the correction data in the memory 105, which stores the potential characteristic of the photosensitive member. As a result, the data on the planar unevenness of the potential characteristic of the photosensitive member 1 as illustrated in FIG. 3A, for correcting the unevenness, can be acquired.

Figure 5B:
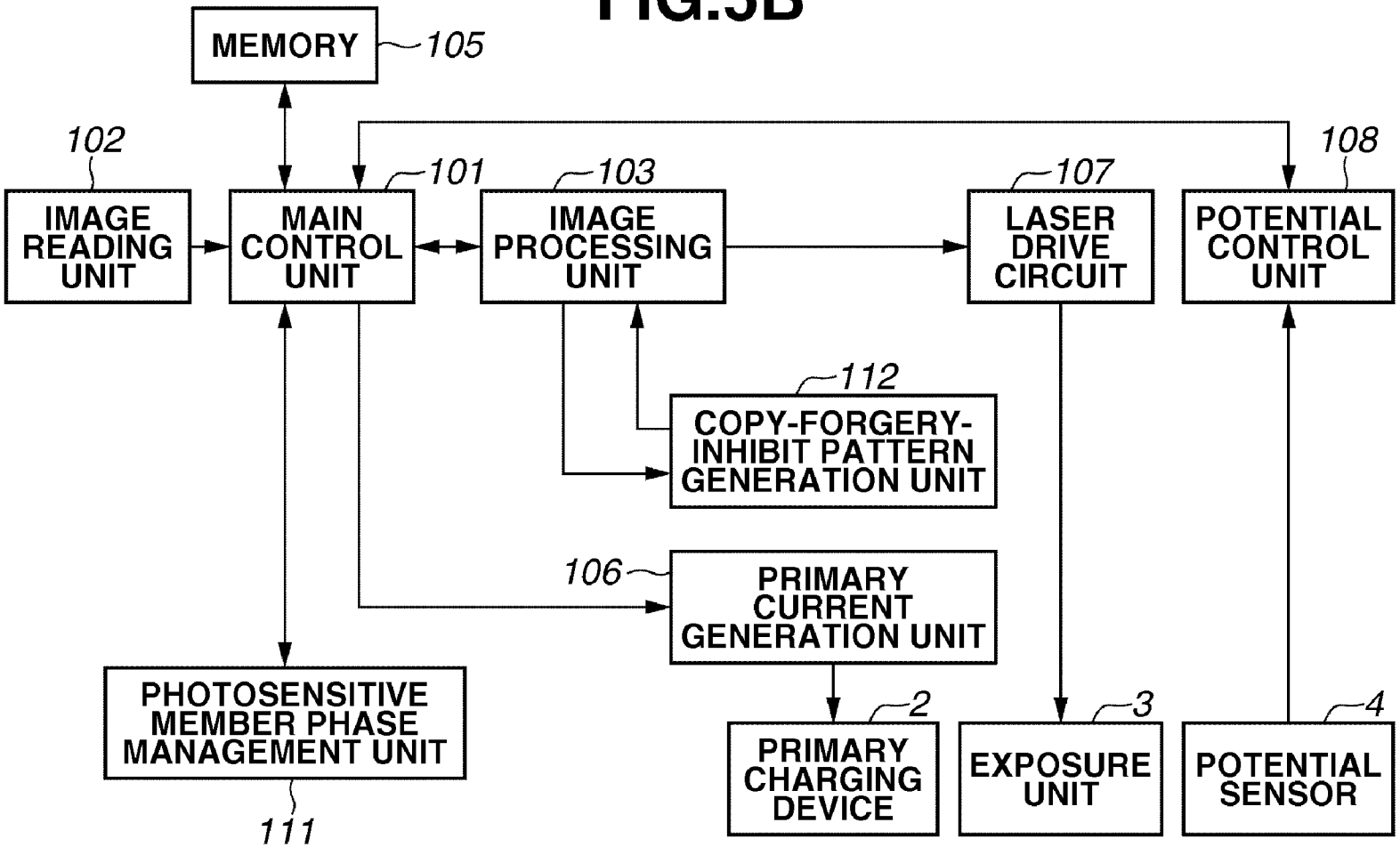
FIG. 5B is a block diagram illustrating a configuration of a control system for retrieving the data on the unevenness of the potential characteristic of the photosensitive member, extracted from the configuration illustrated in FIG. 1.

FIG. 5A is a table illustrating the correction data stored in the memory 105. FIG. 5B is a block diagram illustrating a configuration of the control system for retrieving the data on the unevenness of the potential characteristic of the photosensitive member 1, which is extracted from FIG. 1.

Referring to FIG. 5A, Eij is a potential characteristic component measured by the potential sensor 4, wherein i indicates the component in the main scanning direction of the exposure unit 3, and j indicates the component in the sub-scanning direction. As described above, the exposure unit 3 is disposed in parallel along the main scanning direction of the photosensitive member 1.

The position of the exposure unit 3 in the main scanning direction is defined by a distance from the center of the exposure unit 3. Further, the position of the exposure unit 3 in the sub-scanning direction is defined by an angle from the home position in the rotational direction of the photosensitive member 1 as will be described below.

A method for converting the unevenness of the potential characteristic of the photosensitive member 1 in the image forming apparatus to the exposure intensity of the exposure unit 3 will be described below with reference to FIG. 6.

Figure 6:
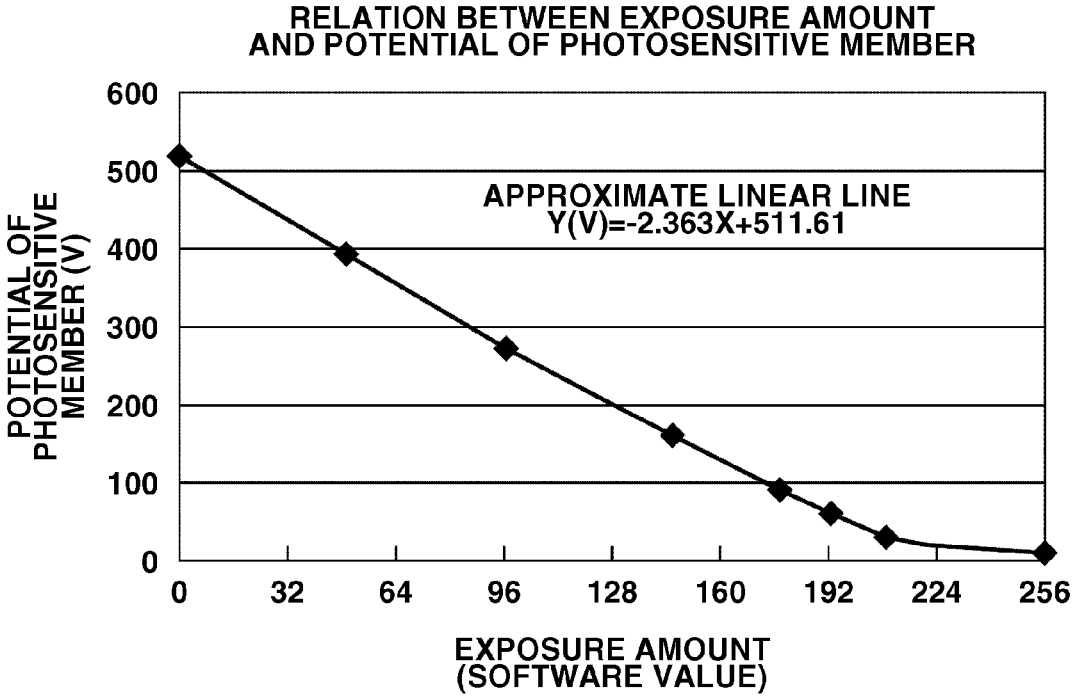
FIG. 6 is a graph illustrating a relation between the exposure amount of the exposure unit and the potential of the photosensitive member in the image forming apparatus.

FIG. 6 is a graph illustrating a relation between the exposure amount of the exposure unit 3 and the potential of the photosensitive member 1. More specifically, FIG. 6 illustrates an example of the relation between the exposure amount of the exposure unit 3 (a software value, i.e., a value which is digitally controlled in 256 steps) and a potential measured by the potential sensor 4 at a position opposite to the potential sensor 4 (a moving position of the potential sensor 4) on the photosensitive member 1. The photosensitive member 1 is charged by the primary charging device 2, so that the potential measured by the potential sensor 4 at the position becomes 520 V.

Further, the laser drive circuit 107 digitally controls the output of the exposure unit 3 in 256 steps. The data indicating the relation illustrated in FIG. 6 can be previously acquired by the image forming apparatus.

The main control unit 101 causes the laser drive circuit 107 to change the exposure intensity of the exposure unit 3. The exposure unit 3 then exposes the photosensitive member 1 which is charged by the primary charging device 2 so that the potential measured at the moving position of the potential sensor 4 is 520 V. The graph illustrated in FIG. 6 is thus acquired.

The position at which the data for illustrating the relation in FIG. 6 can be changed on the plane surface to cover all positions. Further, a potential on an average in the circumferential direction can be measured for a plurality of positions in the main scanning direction.

In the present exemplary embodiment, the data for illustrating the relation in FIG. 6 employs the average value of potentials measured once around the sub-scanning direction at the center of the main scanning direction of the photosensitive member 1. This is in consideration of simplifying the data acquisition process.

When the image forming apparatus forms an image, the relation between the exposure intensity of the exposure unit 3 and the potential of the photosensitive member 1 is comparatively linear when the potential VL is approximately 50 V (i.e., 100 V to 300 V in FIG. 6). The toner image is formed on the photosensitive member 1 at the potential VL, as described above with reference to FIG. 2. An approximate linear line can thus be expressed by an equation described below, wherein the potential of the photosensitive member 1 is Y (V) and an output digital signal of the exposure unit 3 is X. In such a case, the correlation coefficient between X and Y becomes greater than or equal to 99%.

$$Y(V)=-2.363X+511.61$$

Further, the exposure intensity (a digital signal value) of the exposure unit 3 in correcting the unevenness of the potential characteristic of the photosensitive member 1 is indicated as Tij. In Tij, i indicates a position in the main scanning direction and j indicates a position in the sub-scanning direction. Tij can be calculated by the following equation.

In the equation, Dij (V) is an amount of displacement of each measuring point of the data on the unevenness of the potential characteristic of the photosensitive member 1 from a position of an ideal potential of 50 V. In Dij, i indicates a position in the main scanning direction and j indicates a position in the sub-scanning direction, and positive and negative values are included. Further, K is the reference exposure intensity (a digital signal value).

$$Tij=K+Dij$$

As described above, when forming an electrostatic latent image on the photosensitive member, the exposure intensity of the exposure unit 3 along the main scanning direction is changed on the portion of the photosensitive member 1 where the potential is VL. The exposure intensity is changed for each measuring point of the unevenness of the potential characteristic generated after charging and exposing the photosensitive member 1 in the main scanning direction of the photosensitive member 1. As a result, the density unevenness of the toner image caused by the unevenness of the potential characteristic of the photosensitive member 1 can be reduced.

Further, a device performance, such as the charging performance of the primary charging device 2 and the exposure performance in the image forming apparatus may change due to an environmental change when forming an image. In such a case, the reference charging current and the reference exposure intensity are updated based on the potential measured by the potential sensor 4 at the center of the main scanning direction of the photosensitive member 1. The reference charging current and the reference exposure intensity are updated by performing the process illustrated in the flowchart of FIG. 4A.

As illustrated in FIG. 1, the photosensitive member 1 includes the photosensitive member home position sensor 11. The photosensitive member home position sensor 11 detects the home position of the photosensitive member 1 in the rotational direction. Further, the photosensitive member phase management unit 111 manages the rotational phase of the photosensitive member 1.

The photosensitive member phase management unit 111 manages the rotational phase of the photosensitive member 1 based on the home position of the photosensitive member 1 in the rotational direction. The photosensitive member phase management unit 111 thus specifies the position of the photosensitive member 1 exposed by the exposure unit 3 in the sub-scanning direction.

Further, the photosensitive member phase management unit 111 refers to the specified position of the photosensitive member 1 and the correction data. The photosensitive member phase management unit 111 then feeds back the reference results to the control of the exposure intensity performed by the main control unit 101.

A specific example of a method for managing the rotational phase of the photosensitive member 1 in the image forming apparatus will be described below with reference to FIGS. 7A, 7B, and 7C.

Figure 7A:
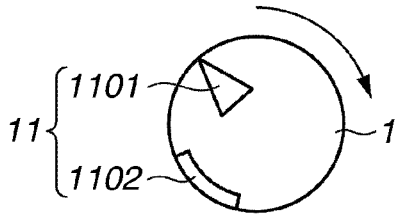
FIG. 7A illustrates a schematic configuration of the photosensitive member home position sensor in the image forming apparatus.

FIG. 7A illustrates a schematic configuration of the photosensitive member home position sensor 11 in the image forming apparatus. FIG. 7B illustrates a schematic configuration of the detection sensor portion of the photosensitive member home position sensor 11. FIG. 7C illustrates the operation state of the photosensitive member home position sensor 11.

Figure 7B:
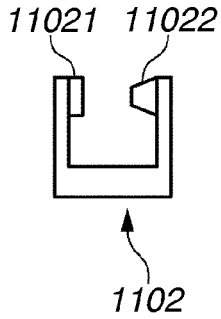
FIG. 7B illustrates a schematic configuration of a detection sensor included in the photosensitive member home position sensor.
Figure 7C:
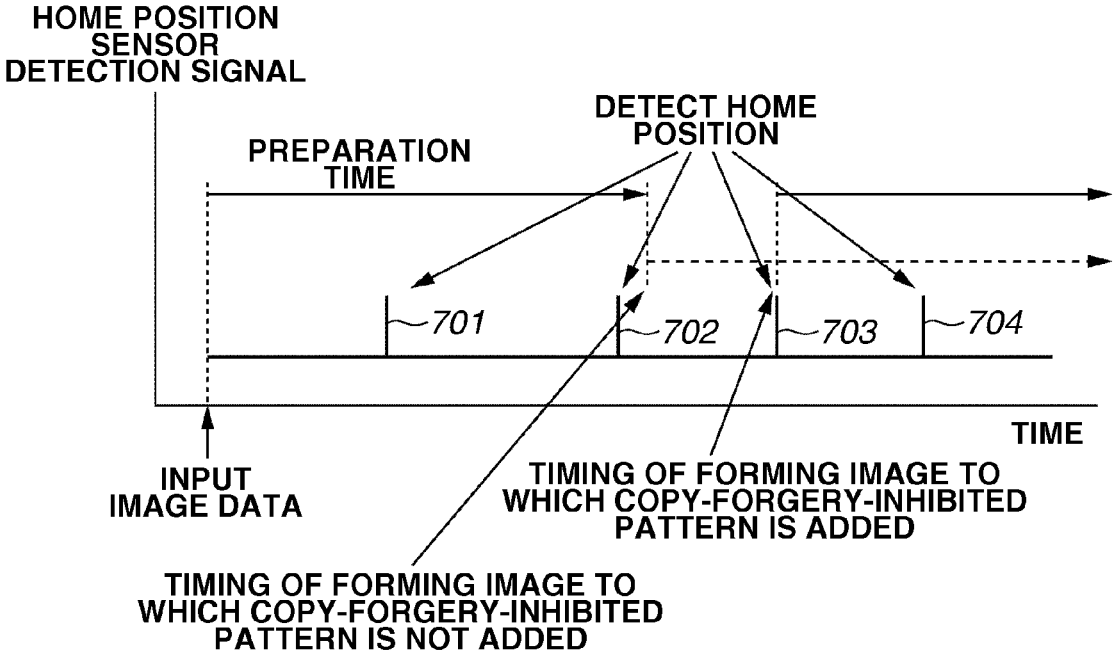
FIG. 7C illustrates operating state of the photosensitive member home position sensor.

Referring to FIGS. 7A and 7B, the photosensitive member home position sensor 11 includes a sensor flag 1101, which rotates along with the photosensitive member 1, and a detection sensor unit 1102, which detects that the sensor flag 1101 has passed through.

The detection sensor unit 1102 is an optical sensor, which includes a light emitting diode (LED) 11021 and a light-sensitive element 11022. When the electrostatic latent image is formed on the photosensitive member 1, the LED 11021 in the detection sensor unit 1102 of the photosensitive home position sensor 11 is switched on.

When there is no sensor flag 1101 between the LED 11021 and the light-sensitive element 11022, the light-sensitive element 11022 detects the light emitted by the LED 11021. On the other hand, if there is the sensor flag 1101 between the LED 11021 and the light-sensitive element 11022, the light emitted from the LED 11021 does not reach the light-sensitive element 11022. The light-sensitive element 11022 thus does not detect the light. Therefore, when the light-sensitive element 11022 does not detect the light, the photosensitive member phase management unit 111 determines that the photosensitive member 1 is at the home position.

The home position detection of the photosensitive member 1 performed when the image is actually formed on the photosensitive member 1 will be described below with reference to FIG. 7C. Referring to FIG. 7C, time is indicated on the horizontal axis, and a detection signal of photosensitive member home position sensor 11 is indicated on the vertical axis.

The photosensitive member home position sensor 11 outputs home position signals 701, 702, 703, and 704 every time the home position of the photosensitive member 1 is detected. The photosensitive member 1 starts rotating when image forming is started on the photosensitive member 1. The photosensitive member home position sensor 11 also starts detection of the home position of the photosensitive member 1 in the rotational direction in synchronization with the rotation of the photosensitive member 1. A minimum length of time for managing the phase of the photosensitive member 1, when unevenness of the photosensitive drum is corrected, is indicated by an arrow 705 illustrated in FIG. 7C.

As described above, the photosensitive member 1 is rotated by the mechanism including the DC motor (not illustrated), so that a certain period of time may be incurred for the rotation to be stabilized. In addition, a certain period of time may be incurred for the rotation speed of the rotational polygonal mirror to be stabilized, so that the light emitted from the exposure unit 3 can scan the photosensitive drum 1.

Further, a period of time is incurred for the fixing apparatus to become a predetermined temperature for fixing toner images transferred to a recording medium. After the preparation time described above, the image forming apparatus starts to form images.

The management by the photosensitive member phase management unit 111 becomes effective from a timing (timing A) when the home position sensor 11 detects the home position of the photosensitive member 1 after the preparation time.

The management of the rotational phase of the photosensitive member 1 is actually performed based on the time accumulated from when the photosensitive member home position sensor 11 detects the home position of the photosensitive member 1. The accumulated time is updated every time the photosensitive member home position sensor 11 detects the home position.

Further, when the unevenness of the potential characteristic of the photosensitive member 1 is also corrected in the sub-scanning direction of the photosensitive member 1, the electrostatic latent image can be formed on the photosensitive member 1 as follows. The electrostatic latent image can be formed after the photosensitive member home position sensor 11 detects the home position of the photosensitive member 1 when the rotation of the photosensitive member 1 has stabilized after image forming is started.

In the present exemplary embodiment, the time used for the rotation of the photosensitive member 1 to be stabilized is approximately 0.7 sec (hereinafter s). Further, a diameter of the photosensitive member 1 is 100 mm, and the moving speed of the photosensitive member 1 in the circumferential direction is 400 mm/s. The time used for the photosensitive member to rotate once can thus be expressed by the following equation.

$$100\times\pi\div400\approx0.785\text{ s}$$

Therefore, if the unevenness of the potential characteristic of the photosensitive member 1 is not to be corrected in the sub-scanning direction of the photosensitive member 1, the time used from the start of the input of an image data to the forming of the electrostatic image on the photosensitive member 1 becomes approximately 0.7 s.

In contrast, when the unevenness of the potential characteristic of the photosensitive member 1 is also to be corrected in the sub-scanning direction of the photosensitive member 1, the maximum length of time used for the rotation speed of the photosensitive member 1 being stabilized can be expressed by the following equation. In such a case, the time also depends on which phase the sensor flag 1101 exists in with respect to the detection sensor 1102.

$$0.7+0.785=1.485\text{ s}$$

The change in the time indicates a change in a first copy time (a first print output time), which is the time from the start of the image forming on the photosensitive member 1 to when the first image is formed on the transfer material and discharged. The first copy time is changed by whether the unevenness of the potential characteristic of the photosensitive member 1 is corrected or not.

More specifically, when the unevenness of the potential characteristic of the photosensitive member 1 is not corrected in the sub-scanning direction of the photosensitive member 1, the first copy time is approximately 2.7 s. On the other hand, when the unevenness of the potential characteristic of the photosensitive member 1 is corrected in the sub-scanning direction, the first copy time becomes approximately 3.5 s at maximum.

The image forming apparatus according to the present exemplary embodiment adds the copy-forgery-inhibit pattern (specific information) to the image read by the image reading unit 102 and forms the image on the photosensitive member 1. A copy product can thus be determined when the document to be copied is copied.

The copy-forgery-inhibit pattern generation unit 112 adds the image data corresponding to the copy-forgery-inhibit pattern to the image data read by the image reading unit 102 form the document or input from a computer to the image forming apparatus. When an image is formed based on the image data to which the data corresponding to the copy-forgery-inhibit pattern is added, the image including the copy-forgery-inhibit pattern is output.

Figure 9:
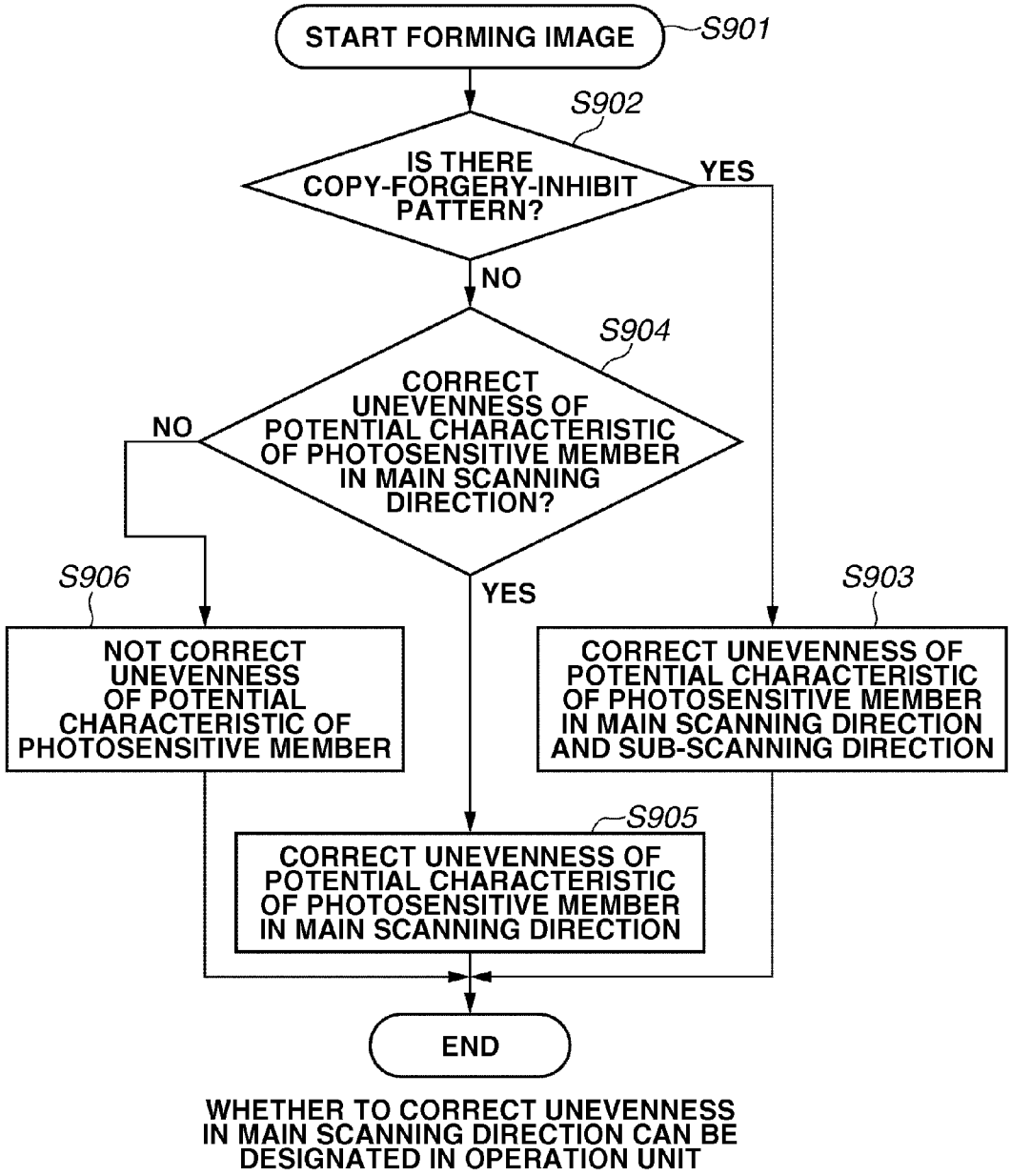
FIG. 9 is a flowchart illustrating a process of determining whether to correct the unevenness of the potential characteristic of the photosensitive member according to whether the copy-forgery-inhibited pattern is added and whether there is a correction instruction.

FIG. 9 is a flowchart illustrating a process of determining whether to correct the unevenness of the potential characteristic of the photosensitive member. The determination is made based on whether the copy-forgery-inhibit pattern is added and whether there is an instruction to correct the unevenness.

In step S901, the main control unit 101 of the image forming apparatus starts forming the image. In step S902, the main control unit 101 determines whether the image is to be output by adding the copy-forgery-inhibit pattern.

If the image is output by adding the copy-forgery-inhibit pattern (YES in step S902), the process proceeds to step S903. More specifically, if the copy-forgery-inhibit pattern generation unit 112 adds the copy-forgery-inhibit pattern configured of minute dots to the image, the process proceeds to step S903. On the other hand, if the image is to be output without addition of the copy-forgery-inhibit pattern (NO in step S902), the process proceeds to step S904.

In step S903, the main control unit 101 changes the exposure intensity of the exposure unit 3 in the main scanning direction and the sub-scanning direction when forming the image. The exposure intensity is changed to correct the unevenness of the potential characteristic of the photosensitive member 1 in the main scanning direction and the sub-scanning direction.

The exposure intensity when forming the image is determined based on the exposure intensity to which the unevenness of the potential characteristic has been converted and the image data read from the document.

In step S904, the main control unit 101 determines whether there is an instruction to correct the unevenness of the potential characteristic in the main scanning direction of the photosensitive member 1. The user can designate whether to correct the unevenness using the operation unit 104 or from a screen of an external information processing apparatus such as the computer.

If there is an instruction to correct the unevenness of the potential characteristic in the main scanning direction of the photosensitive member 1 (YES in step S904), the process proceeds to step S905. In step S905, the main control unit 101 forms the image while changing the exposure intensity of the exposure unit 3 to correct the unevenness. On the other hand, if there is no instruction to correct unevenness of the potential characteristic in the main scanning direction of the photosensitive member 1 (NO in step S904), the process proceeds to step S906. In step S906, the main control unit 101 forms the image by causing the exposure unit 3 to expose the photosensitive member 1 using the above-described reference exposure intensity.

If the unevenness of the potential characteristic of the photosensitive member 1 is corrected in the main scanning direction and the sub-scanning direction of the exposure unit 3, the exposure intensity of the exposure unit 3 is changed for each scan of the exposure unit 3. Further, the potential characteristic data of the photosensitive member 1 used in determining the exposure intensity for each scan of the exposure unit 3 is changed in synchronization with the rotational phase of the photosensitive member 1.

As a result, the unevenness can be corrected. However, in such a case, the rotational phase of the photosensitive member 1 is to be managed. The first copy time may then take 0.785 s longer at maximum compared to when the copy-forgery-inhibit pattern is not added, so that the first copy time becomes approximately 3.5 s.

On the other hand, if the unevenness of the potential characteristic of the photosensitive member 1 is corrected only in the main scanning direction of the exposure unit 3, an average value of all of the potential characteristic components in the sub-scanning direction is employed at each main scanning position. The average value is acquired based on the data stored in the memory 105 (illustrated in FIG. 5B), which stores the correction data for the potential character unevenness of the photosensitive member.

The average value is reflected to the exposure intensity of the exposure unit 3 as described above regardless of the rotational phase of the photosensitive member 1 when forming the image. As a result, the rotational phase of the photosensitive member 1 is to be managed, so that the first copy time becomes 0.785 s shorter than when the copy-forgery-inhibit pattern is added, and thus becomes 2.7 s.

The status of correcting the unevenness of the potential characteristic of the photosensitive member 1 will be described below with reference to FIGS. 10A, 10B, 11A, and 11B.

Figure 10B:
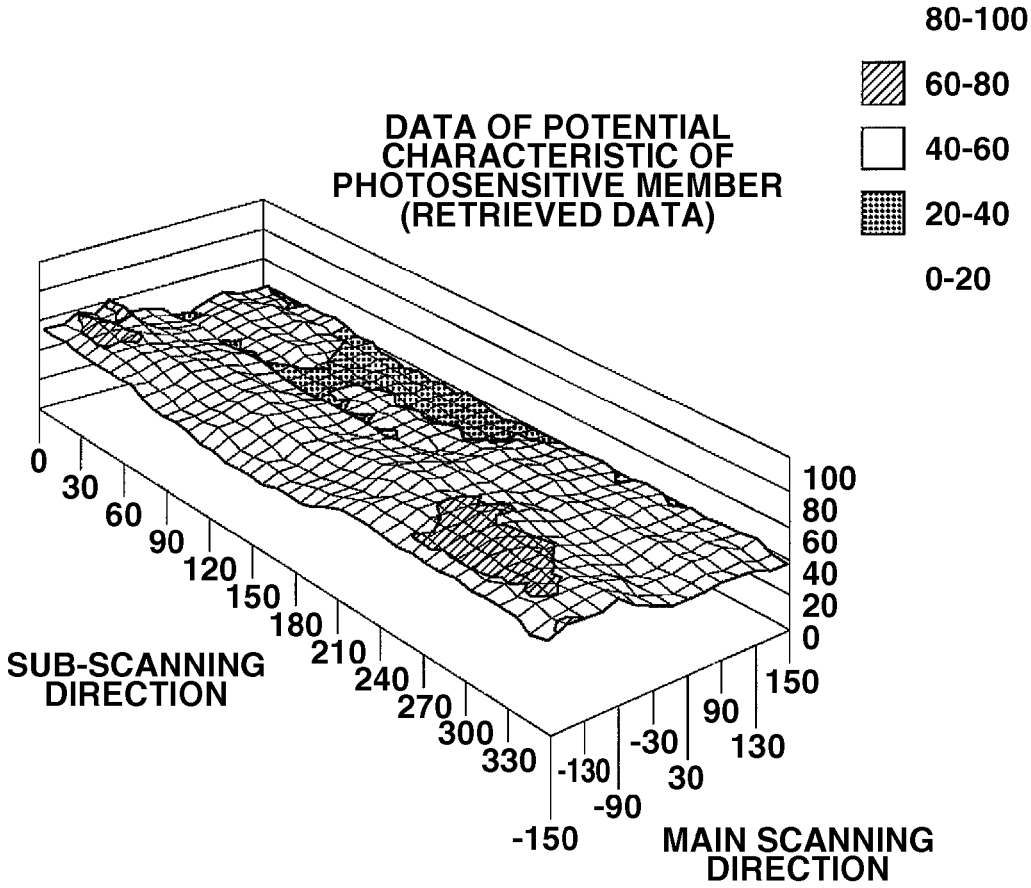
FIG. 10B is a graph schematically illustrating correction data (retrieved data) to be used for correcting the unevenness of the potential characteristic of the photosensitive member.

FIG. 10A illustrates the data (retrieved data) on the potential characteristic of the photosensitive member when the unevenness of the potential characteristic is not corrected using the exposure intensity of the exposure unit 3. FIG. 10B is a schematic diagram illustrating the data on the potential characteristic of the photosensitive member in FIG. 10A.

Figure 11B:
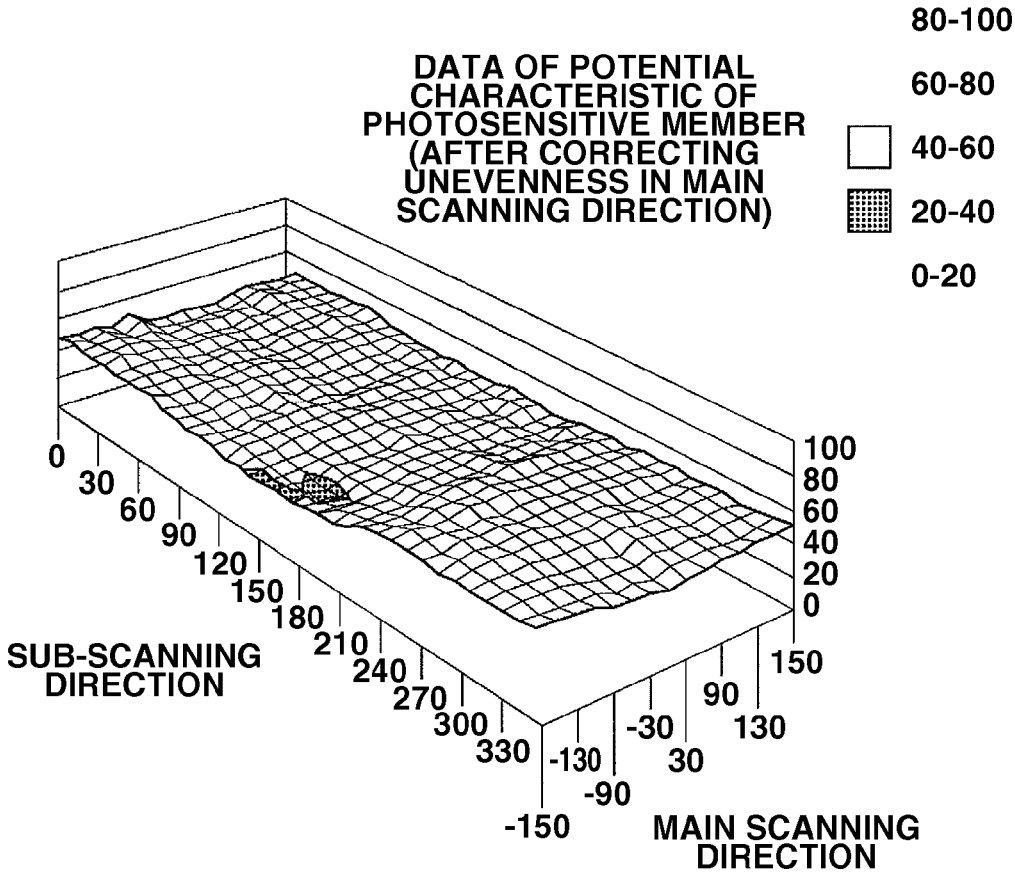
FIG. 11B is a graph schematically illustrating the data on the potential characteristic of the photosensitive member.

FIG. 11A illustrates data on the potential characteristic of the photosensitive member when the unevenness of the potential characteristic is corrected using the exposure intensity of the exposure unit 3. More specifically, the correction is performed by changing the exposure intensity only in the main scanning direction and not in the sub-scanning direction. Such data is also referred to as data after performing correction in the main scanning direction. FIG. 11B is a schematic diagram illustrating the data on the potential characteristic of the photosensitive member 1 illustrated in FIG. 11A.

Referring to FIGS. 10A and 11A, the position in the main scanning direction is indicated on the horizontal axis (mm from the center), and the position in the sub-scanning direction is indicated on the vertical axis (degrees (°) from the home position of photosensitive member 1). Referring to FIGS. 10B and 11B, the sub-scanning direction of the photosensitive member 1 is indicated in the longer direction, the main scanning direction of the photosensitive member 1 is indicated in the longer direction, and the potential (V) is indicated in the vertical direction.

In FIG. 10B, a region where the potential is "60-80" is indicated by diagonal lines, "40-60" is indicated by a solid color, and "20-40" is indicated by dotted lines. Regions where the potentials are "80-100" and "0-20" are not illustrated. In FIG. 11B, a region where the potential is "40-60" is indicated by solid color, and a region where the potential is "20-40" is indicated by dotted lines. Regions where the potentials are "80-100", "60-80", and "0-20" are not illustrated.

In theory, when the unevenness of the potential characteristic of the photosensitive member 1 is corrected by appropriately changing the exposure intensity of the exposure unit 3 in both the main scanning direction and the sub-scanning direction, there is no unevenness after the correction. As described above, the unevenness of the potential characteristic can be reduced to half of the original as illustrated in FIG. 11B, even if the exposure intensity is changed only in the main scanning direction and not in the sub-scanning direction.

As described above, according to the present exemplary embodiment, when the copy-forgery-inhibit pattern is added to the image to be output, the exposure intensity of the exposure unit 3 is changed while forming the image. The exposure intensity is changed in the main scanning direction and the sub-scanning direction to correct the unevenness of the potential characteristic of the photosensitive member 1. Further, when the image is output without adding the copy-forgery-inhibit pattern, the exposure intensity of the exposure unit 3 is not changed in at least the sub-scanning direction.

As a result, a high quality image can be formed by the addition of the copy-forgery-inhibit pattern, by appropriately correcting the unevenness of the potential characteristic in the image. Further, the first copy time can be shortened when forming an image in which it is unnecessary to add the copy-forgery-inhibit pattern.

Furthermore, when an image is formed by adding the copy-forgery-inhibit pattern, the image can be formed with high quality by reducing the unevenness of the image density caused by the unevenness of the potential characteristic of the photosensitive member 1. The first copy time can be shortened for other images, and user-friendliness can thus be improved.

The present invention is more effective when a new job is input after all jobs are processed that are input in the image forming apparatus for image forming. Usually, the time used for the fixing apparatus to reach a target temperature is longer than the time used for a stable rotation speed of a photosensitive drum to be obtained. However, when a new job is input after all jobs are processed, the temperature of the fixing apparatus stays around the target temperature. Therefore, there may be a case that the time used for the fixing apparatus to reach the target temperature is shorter than the time used for the photosensitive drum to rotate in a stable speed. In this case, the present invention is especially effective.

The second exemplary embodiment of the present invention is different from the above-described first exemplary embodiment as described below. In the second exemplary embodiment, an image including specific encryption information formed of minute dots is used as a reference for changing the processing method, including whether to correct the unevenness of the potential characteristic of the photosensitive member 1.

The image including the specific encryption information (hereinafter referred to as an encryption image) is an image formed of minute dots or yellow dots and is thus not easily visible. When forming the encryption image, the unevenness of the potential characteristic may affect the encryption image to become more visible than necessary.

In the present exemplary embodiment, the unevenness of the potential characteristic is corrected when the encryption image is added to the image to be output. Further, when an image is output without adding the encryption image, the unevenness of the potential characteristic is not corrected in at least the sub-scanning direction.

The present exemplary embodiment is different from the above-described first exemplary embodiment in that the image to be added to the image to be output is the encryption image. Other configuration of the present exemplary embodiment is similar to the configuration of the first exemplary embodiment.

Figure 12:
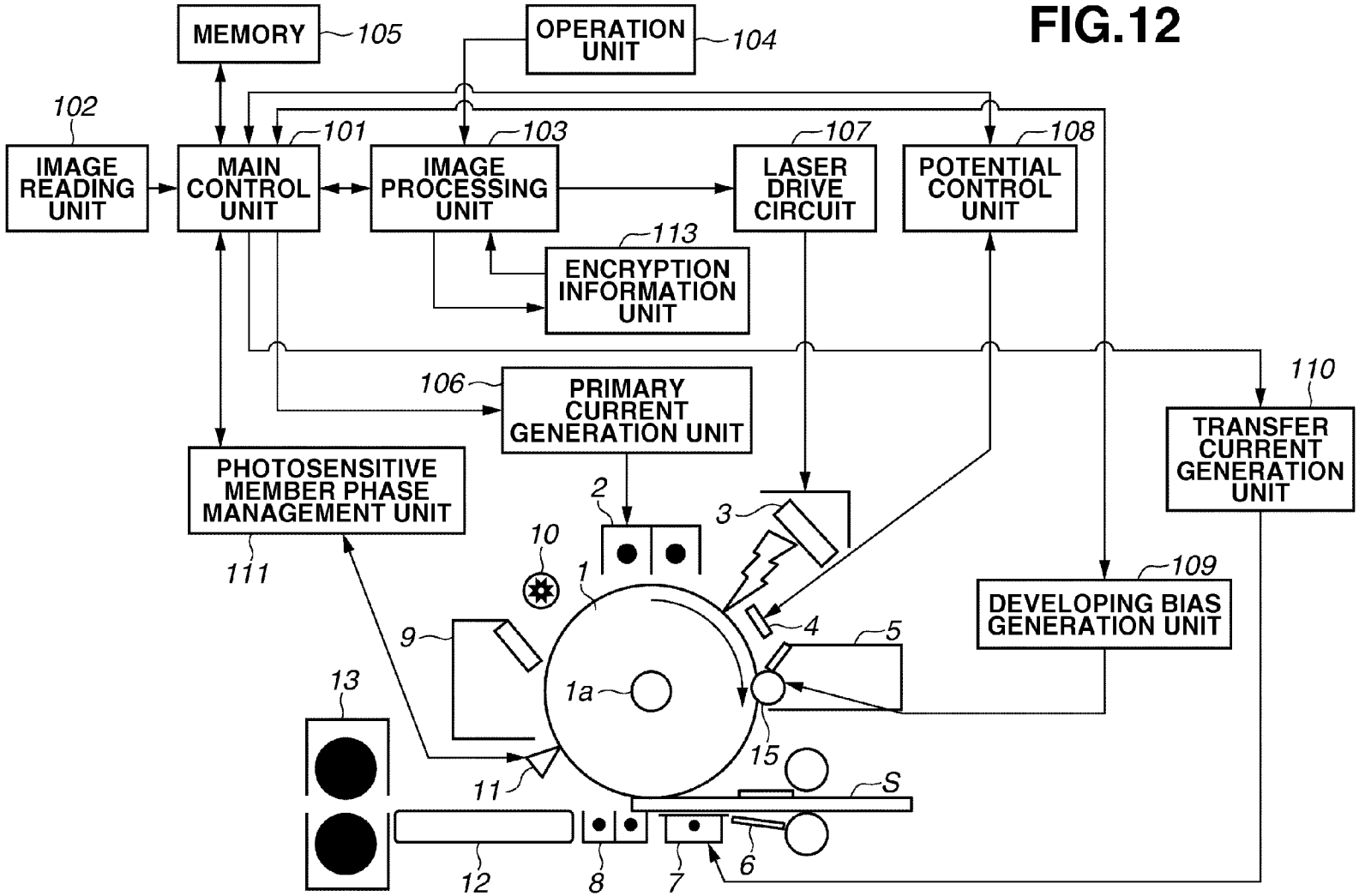
FIG. 12 illustrates a configuration of the image forming apparatus according to a second exemplary embodiment of the present invention.

FIG. 12 illustrates a configuration of the image forming apparatus according to the present exemplary embodiment of the present invention. The configuration illustrated in FIG. 12 is an example of realizing the exposure unit, the correction unit, the control unit, the detection unit, the management unit, the image reading unit, and the encryption unit of the present invention.

Referring to FIG. 12, the image forming apparatus includes the photosensitive member 1, the primary charging device 2, the exposure unit 3, the potential sensor 4, the developing device 5, the transfer device 7, the separation charging device 8, the cleaning unit 9, the pre-exposure unit 10, and the photosensitive member home position sensor 11.

Further, the image forming apparatus includes the main control unit 101, the image reading unit 102, the image processing unit 103, the operation unit 104, the memory 105 for storing data of unevenness of the potential characteristic of the photosensitive member, the primary current generation unit 106, and the laser drive circuit 107. Furthermore, the image forming apparatus includes the potential control unit 108, the developing bias generation unit 109, the transfer current generation unit 110, the photosensitive member phase management unit 111, an encryption information unit 113, the conveyance registration unit 6, the conveyance unit 12, and the fixing device 13.

In the present exemplary embodiment, the image forming apparatus includes the encryption information unit 113 instead of the copy-forgery-inhibit pattern generation unit 112 included in the image forming apparatus illustrated in FIG. 1. Moreover, the main control unit 101 performs processes illustrated in the flowchart of FIG. 13 instead of the flowchart of FIG. 9. Other than those, the second exemplary embodiment is similar to the corresponding elements in the first exemplary embodiment (FIG. 1), and a detailed description will be omitted.

The feature operation of the image forming apparatus according to the present exemplary embodiment will be described below with reference to FIGS. 12 and 13.

The image forming apparatus according to the present exemplary embodiment adds the encryption image to the image to be output. More specifically, the encryption information unit 113 adds the encryption image including specific encryption information (specific information) formed of minute dots to the image to be output. The image forming apparatus can thus output the image in which the encryption image is added.

As a result, if the user uses the image reading unit 102 to copy the image in which the encryption image is added, the encryption image is decrypted, and copying can be restricted according to the decrypted result.

The encryption image can include function information (such as date and time the image is formed and an identification code of the image forming apparatus) for tracing the image formed by the image forming apparatus. Further, the encryption image can be added to the image using a known n-dimension code technique (wherein n is a counting number), e.g., bar code and quick response (QR) code.

However, the encryption image is different from the general QR code. The encryption image in the entire image surface for a plurality of times is repeatedly dispersed, so that the encryption image can be restored even if a specific portion of the encryption image is deleted.

Further, since the encryption image is dispersed in the entire image surface, the appropriate size of the dot based on the specification of the n-dimension code technique is 600 dpi at 2×2 pixels (80 μm×80 μm). The formed image can thus be prevented from being difficult to read.

The image can thus be restricted from copying or can be appropriate traced if the encryption image configured of minute dots formed under the above-described condition are uniformly dispersing in the image and is restorable (reproducible).

In order to realize the above, the minute dots inside the image plane are to be uniformly reproduced as much as possible when the encryption image is added to the image. In such an aspect, when an image to which the encryption image configured of minute dots is formed on the photosensitive member 1, the unevenness of the potential characteristic of the photosensitive member 1 is to be corrected.

In the present exemplary embodiment, the method for correcting the unevenness in the potential characteristic of the photosensitive member 1 is changed based on whether the encryption information formed of minute dots is added to the image. Whether the correction is performed also depends on the addition of the encryption image. Further, the encryption image in the present exemplary embodiment is formed of minute dots of a diameter of 0.2 mm or less. The image in the present exemplary embodiment is either an image read from the document, or an image read from the document to which the encryption image configured of minute dots is added.

Figure 13:
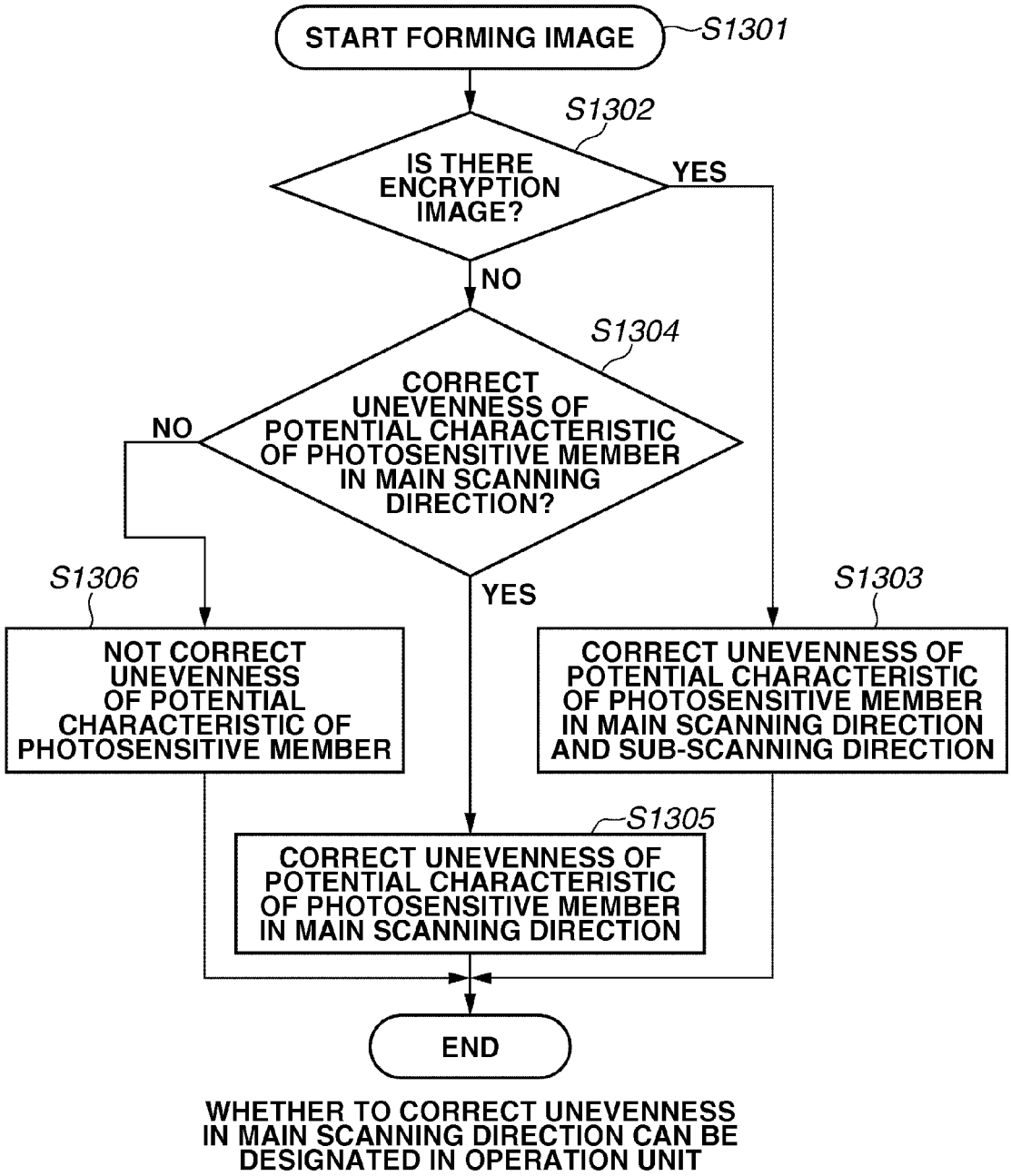
FIG. 13 is a flowchart illustrating a process of determining whether to correct the unevenness of the potential characteristic of the photosensitive member based on whether encryption information is added and whether there is a correction instruction.

FIG. 13 is a flowchart illustrating a process of determining whether to correct the unevenness of the potential characteristic of the photosensitive member. The determination is made according to whether the encryption image is added and whether there is an instruction to correct the unevenness.

In step S1301, the main control unit 101 of the image forming apparatus starts forming the image. In step S1302, the main control unit 101 determines whether the image is to be output by adding the encryption image. If the image is to be output by adding the encryption image (i.e., is there encryption image) (YES in step 1302), the process proceeds to step S1303. On the other hand, if the image is to be output without adding the encryption image (NO in step S1302), the process proceeds to step S1304.

In step S1303, the main control unit 101 changes the exposure intensity of the exposure unit 3 while forming the image. The exposure intensity is switched to correct the unevenness of the potential characteristic of the photosensitive member 1 in the main scanning direction and the sub-scanning direction.

In step S1304, the main control unit 101 does not control the exposure intensity in the sub-scanning direction. The main control unit 101 then determines whether there is an instruction to correct the unevenness of the potential characteristic in the main scanning direction of the photosensitive member 1. In such a case, the user can designate whether to correct the unevenness using the operation unit 104.

If there is an instruction to correct the unevenness of the potential characteristic in the main scanning direction of the photosensitive member 1 (YES in step S1304), the process proceeds to step S1305. In step S1305, the main control unit 101 forms the image by changing the exposure intensity of the exposure unit 3 to correct the unevenness.

On the other hand, if there is no instruction to correct unevenness of the potential characteristic in the main scanning direction of the photosensitive member 1 (NO in step S1304), the process proceeds to step S1306. In step S1306 (i.e., the process does not correct unevenness of potential characteristic of photosensitive member), the main control unit 101 forms the image by causing the exposure unit 3 to expose the photosensitive member 1 using the above-described reference exposure intensity.

As described above, according to the present exemplary embodiment, the forming of a high quality image and a shortened first copy time can both be realized as in the above-described first exemplary embodiment. Further, when an image to which the encryption image including the specific encryption information (specific information) requiring a high image quality is to be output, the unevenness in the potential characteristic of the photosensitive member 1 in the sub-scanning direction is corrected. As a result, the in-plane unevenness of the image density caused by the unevenness of the potential characteristic of the photosensitive member 1 can be reduced.

When forming other images, the first copy time can be shortened, so that user-friendliness can be improved.

In the third exemplary embodiment of the present invention, the method for forming the image when the copy-forgery-inhibit pattern is not added to the image to be output is different from the first exemplary embodiment. The other elements are similar to the corresponding elements of the above-described first exemplary embodiment (illustrated in FIG. 1), and a detailed description will be omitted.

In the present exemplary embodiment, the unevenness in the potential characteristic of the photosensitive member 1 is corrected when forming an image if the copy-forgery-inhibit pattern is not added to the image to be output. The unevenness is corrected by also changing the exposure intensity of the exposure unit 3 in the sub-scanning direction.

However, the exposure intensity is controlled using a different method from the method performed when the copy-forgery-inhibit pattern is to be added to the image to be output as illustrated in the first exemplary embodiment, for changing the exposure intensity in the sub-scanning direction to shorten the first copy time.

According to the present exemplary embodiment, when the copy-forgery-inhibit pattern is to be added to the image to be output, the unevenness in the potential characteristic of the photosensitive member 1 is corrected by changing the exposure intensity of the exposure unit 3. More specifically, the exposure intensity is changed in the main scanning direction of the photosensitive member 1 and in the rotational direction according to the rotational phase of the photosensitive member 1.

When the copy-forgery-inhibit pattern is not added to the image to be output, the unevenness is corrected by predicting the unevenness of the potential characteristic from the main scanning direction and the phase of the photosensitive member 1 in the previous image forming process. The exposure intensity of the exposure unit 3 can then be changed in the rotational direction according to the rotational phase of the photosensitive member 1 to correct the unevenness.

Further, when the copy-forgery-inhibit pattern is not added to the image to be output, the unevenness is corrected as described below during a period between the start of forming the image and when the rotational phase of the photosensitive member 1 becomes manageable. The unevenness is corrected by predicting the unevenness of the potential characteristic from the main scanning direction and the phase of the photosensitive member 1 in the previous image forming process. The exposure intensity of the exposure unit 3 can then be changed in the rotational direction according to the rotational phase of the photosensitive member 1 to correct the unevenness.

After the rotational phase of the photosensitive member 2 becomes manageable, the unevenness of the potential characteristic can be corrected by changing the exposure intensity of the exposure unit 3 in the main scanning direction and in the rotational direction according to the rotational phase of the photosensitive member 1.

Furthermore, when the copy-forgery-inhibit pattern is not added to the image to be output, the unevenness is corrected by predicting the unevenness of the potential characteristic from the main scanning direction of the photosensitive member 1 and the phase of the photosensitive member 1 in the previous image forming. The exposure intensity of the exposure unit 3 can then be changed in the rotational direction according to the rotational phase of the photosensitive member 1 to correct the unevenness. Moreover, the correction rate is maintained below 100%.

The feature operation of the image forming apparatus including the above configuration according to the present exemplary embodiment will be described below with reference to FIGS. 14 and 15.

Figure 14:
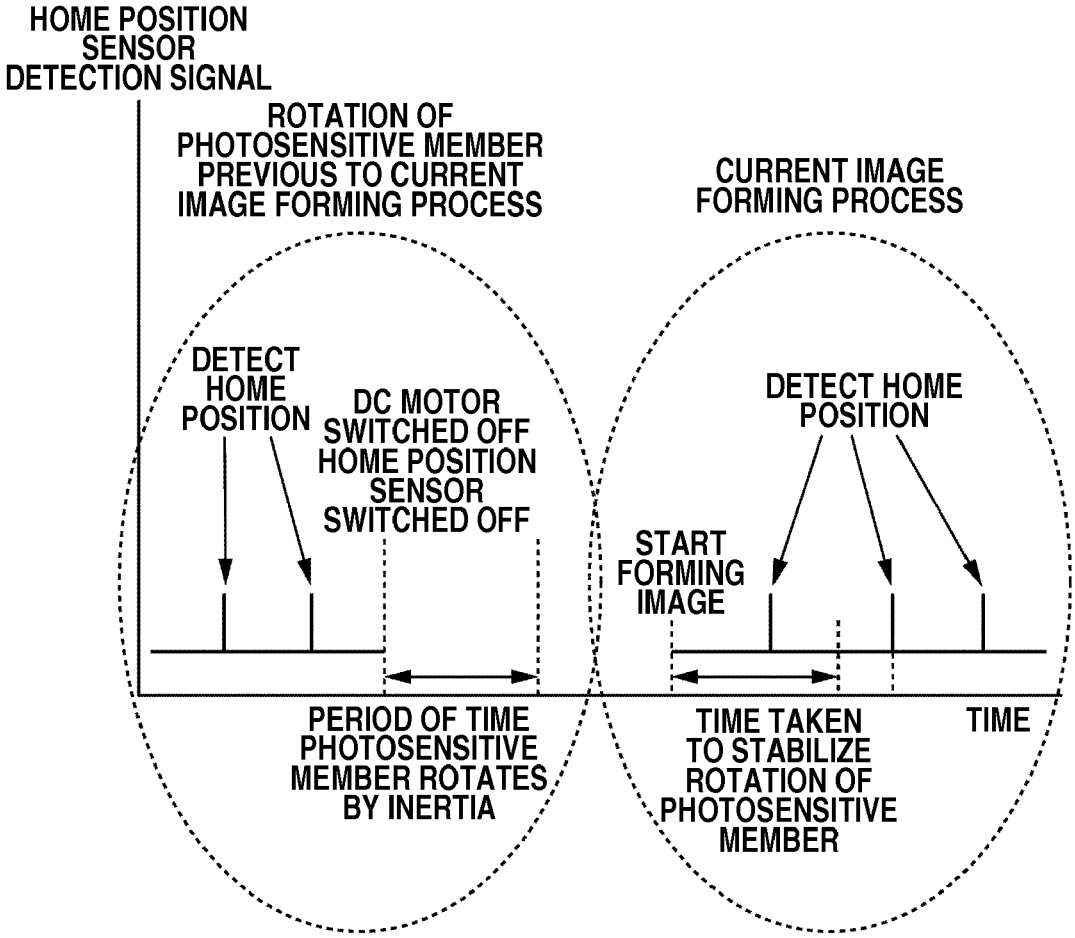
FIG. 14 illustrates a relation between a rotation status of the photosensitive member and a detection signal of the home position sensor when the copy-forgery-inhibited pattern is not added to the image in the image forming apparatus according to a third exemplary embodiment of the present invention.

FIG. 14 illustrates a relation between the rotation status of the photosensitive member and the detection signal of the home position sensor when the copy-forgery-inhibit pattern is not added to the image to be output.

Referring to FIG. 14, the rotational phase of the photosensitive member 1 is determined by the following rotational phases: the rotational phase of the photosensitive member 1 previous to the subject image forming process, a phase in which the photosensitive member 1 rotates through inertia after the DC motor for rotating the photosensitive member 1 is switched off; and a phase in which the photosensitive member 1 rotates until the rotation is stabilized.

In the present exemplary embodiment, the diameter of the photosensitive member 1 is 100 mm, and the moving velocity of the photosensitive member 1 in the circumferential direction is 400 mm/s. Further, the average time taken for the photosensitive member 1 to stop rotating from when switching the DC motor off is 0.5 s, and the average time taken for the rotation of the photosensitive member 1 to be stabilized is 0.6 s.

If a phase from the home position of the photosensitive member 1 is $\alpha°$ when starting the image forming process, the phase $\alpha$ can be calculated using the following equation. The phase at which the DC motor is switched off when the photosensitive member 1 is rotated previous to the subject image forming process is $\beta°$.

$$\alpha = \beta + \left\{\frac{400 \times (0.5 + 0.6)}{100 \times \pi}\right\}$$

Therefore, when the image is formed, the exposure intensity of the exposure unit 3 is started to change at the phase $\alpha°$ from the home position of the photosensitive member 1. As a result, the unevenness in the potential characteristic of the photosensitive member 1 is corrected.

Further, the rotation of the photosensitive member 1 previous to the subject image forming process may be a rotation related to the image forming operation. However, the photosensitive member 1 may be rotated by a power other than the DC motor such as when forming the image or when there is a paper jam directly after the image forming apparatus is switched on. In such a case, the rotational phase of the photosensitive member 1 in the image forming process previous to the subject image forming process cannot be used.

Therefore, in the present exemplary embodiment, the photosensitive member 1 is rotated for a minimum length of time 705 (illustrated in FIG. 7C) or longer to manage the phase of the photosensitive member 1. The photosensitive member 1 is rotated as such when the image forming apparatus is switched on or when a door (not illustrated) of the image forming apparatus is opened. More specifically, the photosensitive member 1 is made to be rotated previous to the subject image forming process.

Further, if the rotational phase of the photosensitive member 1 is determined by prediction in the image forming apparatus, a displacement may be generated from the actual rotational phase of the photosensitive member 1. In this aspect, the correction residual error may become smaller when the correction rate of the unevenness of the potential characteristic is below 100% rather than when the correction rate is 100% in which there may be excessive correction.

The present exemplary embodiment uses a correction coefficient (correction rate), which indicates a percentage of correction to be performed on the unevenness of the potential characteristic of the photosensitive member 1.

The correction coefficient is generated by the displacement of the estimated phase from the actual phase of the photosensitive member 1. The displacement is caused by the difference between the previously estimated sum of the time taken for the photosensitive member 1 to stop after the DC motor is switched off and the time used for the rotation of the photosensitive member 1 to be stabilized, and a sum of a subsequent period.

The sum of the subsequent period is the actual sum of the time taken for the photosensitive member 1 to stop after the DC motor of each image forming apparatus is switched off, and the time taken for the rotation of the photosensitive member 1 to be stabilized. The sum of the subsequent period depends on the characteristic of the DC motor that drives the photosensitive member 1 in each image forming apparatus. In the present exemplary embodiment, the appropriate correction coefficient can thus be input from the operation unit 104.

A method for calculating the exposure intensity of the exposure unit 3 when the correction coefficient is used will be described below.

As described in the first exemplary embodiment, the relation between the exposure intensity of the exposure unit 3 and the potential of the photosensitive member 1 is comparatively linear when the potential VL at which the toner image is formed on the photosensitive member 1 is 50 V. More specifically, the relation is relatively linear around 100 V to 300 V illustrated in FIG. 6. The approximate linear line can then be expressed by the following equation in which the potential of the photosensitive member 1 is Y (V) and the digital signal output from the exposure unit 3 is X. In such a case, the correlation coefficient between X and Y becomes greater than or equal to 99%.

$$Y(V)=-2.363X+511.61$$

Further, the main control unit 101 can calculate the correlation coefficient of the above-described case for each image forming apparatus. The correlation coefficient can also be calculated according to the usage history and the usage environment of the image forming apparatus.

The exposure intensity (digital signal value) T3ij (wherein i is the position in the main scanning direction and j is the position in the sub-scanning direction), for correcting the unevenness of the potential characteristic of the photosensitive member 1 can be calculated using the following equation.

In the equation, D3ij (wherein i is the position in the main scanning direction and j is the position in the sub-scanning direction) is the amount of displacement from the ideal potential 50 V at each measuring point in the acquired data on the unevenness of the potential characteristic of the photosensitive member 1. D3ij includes both positive and negative values. Further, K3 is the reference exposure intensity, and the correction coefficient is indicated as θ%.

$$T3ij=K3+(D3ij/-2.363)\times\theta/100$$

Figure 15A:
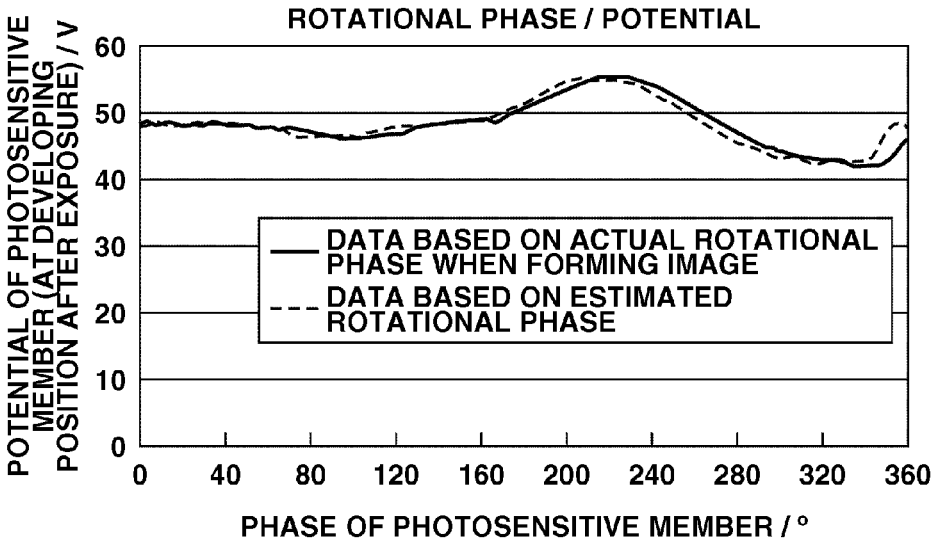
FIG. 15A illustrates the unevenness of the potential characteristic in the sub-scanning direction acquired from the actual rotational phase and an estimated rotational phase of the photosensitive member.
Figure 15B:
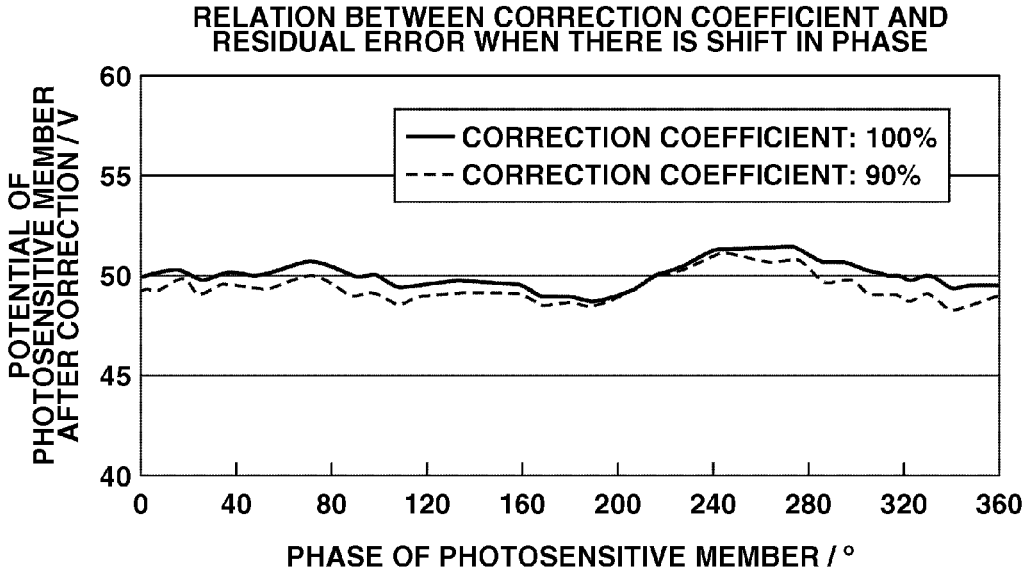
FIG. 15B is a graph illustrating a relation between a correction coefficient and a correction residual error when there is a shift in the phase.
Figure 16:
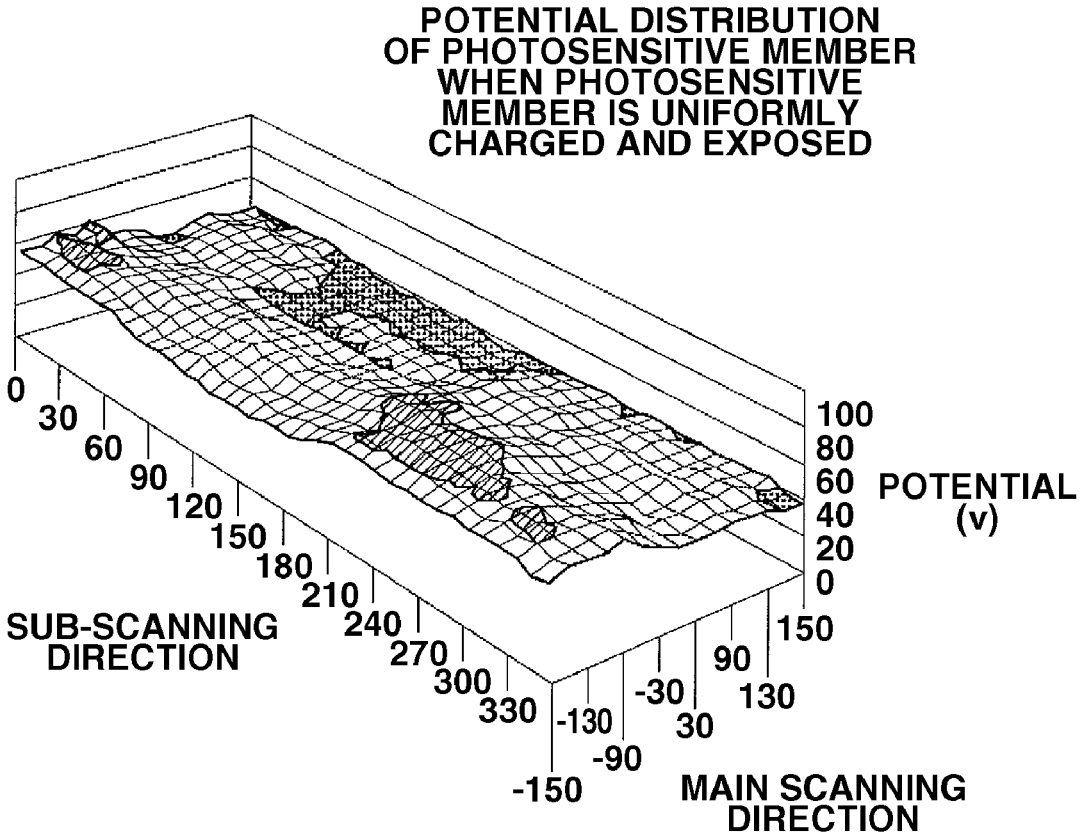
FIG. 16 is a graph illustrating a potential distribution of the photosensitive member when the photosensitive member is uniformly charged and exposed in the conventional image forming apparatus.
Figure 17:
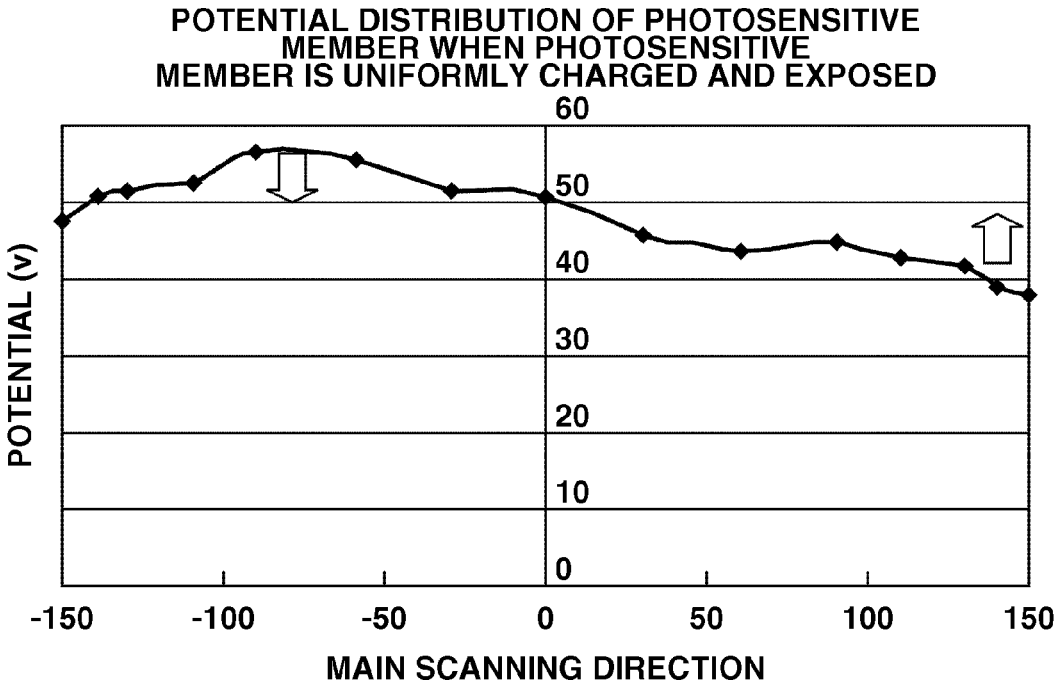
FIG. 17 is a graph illustrating a potential distribution of the photosensitive member (one scan line in the main scanning direction) when the photosensitive member is uniformly charged and exposed.
Figure 18:
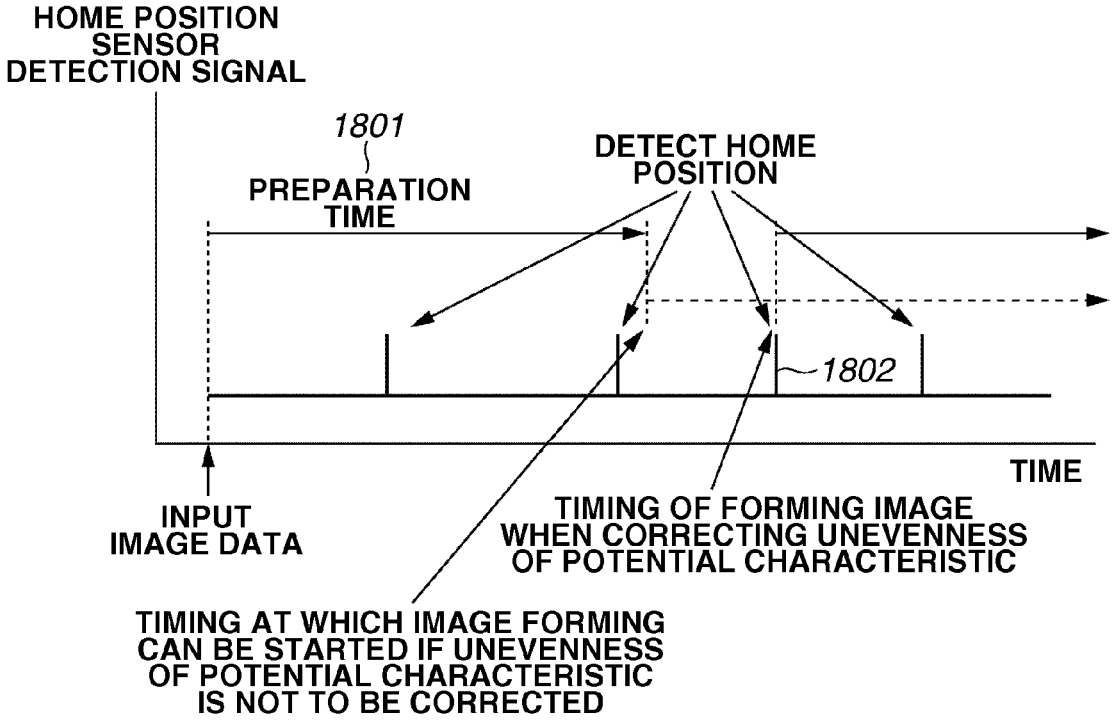
FIG. 18 illustrates a relation between the rotation state of the photosensitive member and the detection signal of the home position sensor.

FIG. 15A is a graph illustrating the unevenness of the potential characteristic in the sub-scanning direction acquired from the actual rotational phase and the estimated rotational phase of the photosensitive member. FIG. 15B is a graph illustrating a relation between the correction coefficient and the correction residual when the phase is displaced.

Referring to FIG. 15A, the rotational phase of the photosensitive member 1 is indicated on the horizontal axis and the potential (V) at the developing position of the photosensitive member 1 after being exposed is indicated on the vertical axis. Referring to FIG. 15B, the rotational phase of the photosensitive member 1 is indicated on the horizontal axis and the potential (V) of the photosensitive member 1 after correction is indicated on the vertical axis.

Referring to FIG. 15B, the unevenness of the potential characteristic of the photosensitive member 1 is corrected based on the exposure intensity of the exposure unit 3 in each image forming apparatus. As a result, the maximum value of the correction residual error is smaller when the correction coefficient (correction rate) is 90% as compared to when the correction coefficient is 100%.

As described above, according to the present exemplary embodiment, the image can be formed with high quality and the first copy time can be shortened similarly as in the first exemplary embodiment.

A case where the unevenness of the potential characteristic is corrected in a color image forming apparatus will be described in a fourth exemplary embodiment. More specifically, the necessity for correcting the unevenness of the potential characteristic when forming an image including a photograph or a picture will be described below.

When outputting an image such as the photograph, the gradation level is important. Therefore, if there is unevenness of the potential characteristic of the photosensitive member 1, the gradation level may be affected.

For example, an image may be output from an apparatus that can form an image using 256 gradation levels for each color. In such a case, if there is unevenness of the potential characteristic of the photosensitive member 1, the density corresponding to image data whose gradation is 200 and the density corresponding to image data whose gradation is 201 may be reversed.

More specifically, in the output image, the density corresponding to the image data of gradation level 201 is normally higher than that of the image data of gradation level 200. However, if there is unevenness in the potential characteristic, the density corresponding to the image data of gradation level 200 may become higher than that of the image data of gradation level 201 depending on the position where the image is formed on the photosensitive member 1 based on each data.

To overcome this, an image including pictures such as the photograph without affecting the gradation level is outputted, by correcting the unevenness of the potential characteristic. However, since the color image forming apparatus is also used for outputting an image, which only includes a document, a first copy output time (FCOT) for outputting the image, which only includes a document, is to be reduced.

Therefore, the color image forming apparatus in the present exemplary embodiment determines whether the image to be output includes the image corresponding to a picture such as the photograph. If the picture is included, the unevenness of the potential characteristic is corrected in the main scanning direction and the sub-scanning direction.

On the other hand, if the image such as the picture is not included, the color image forming apparatus starts to form the image regardless of whether the home position sensor has detected the home position of the photosensitive member 1. In other words, the unevenness of the potential characteristic is not corrected at least in the sub-scanning direction. The method for correcting the unevenness of the potential characteristic is similar to the method described in the first exemplary embodiment, and description will be omitted.

Figure 19:
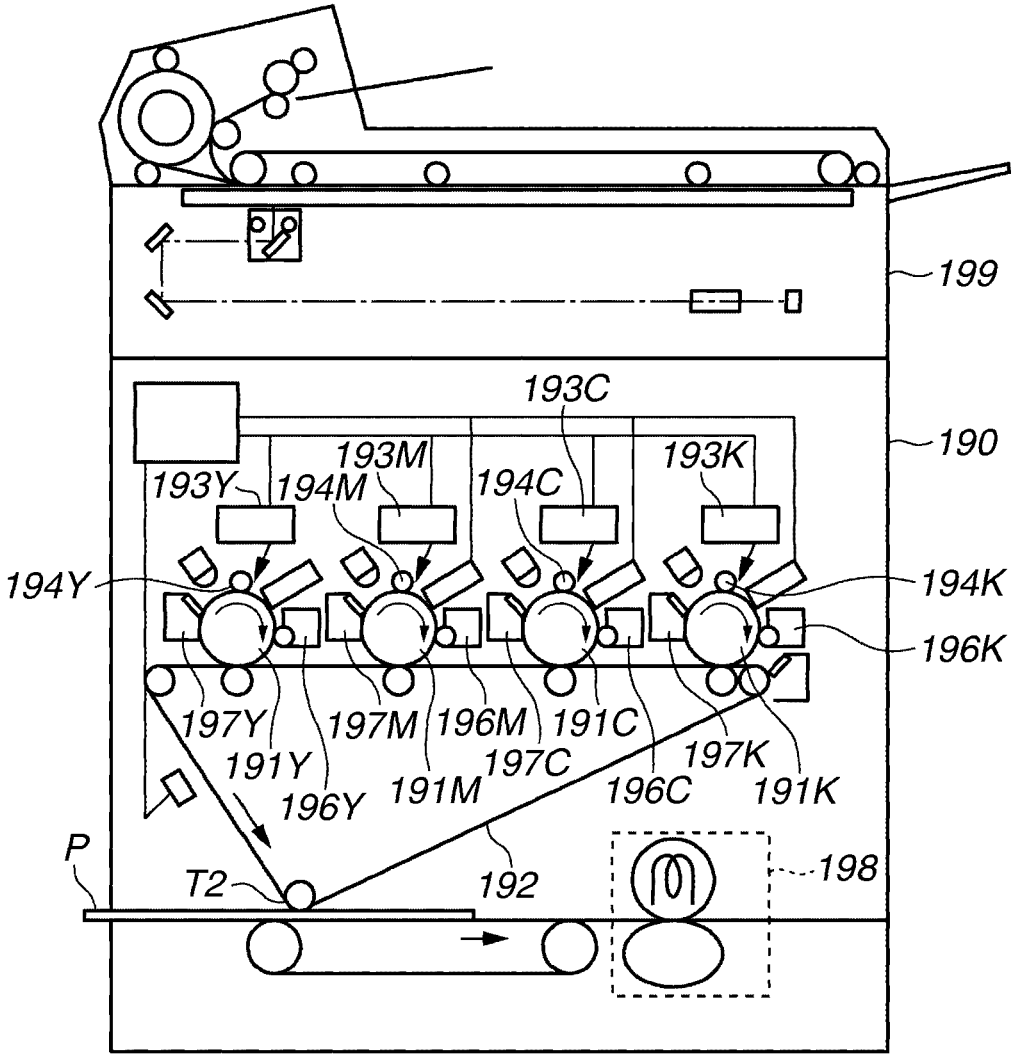
FIG. 19 illustrates a color image forming apparatus according to a fourth exemplary embodiment of the present invention.

FIG. 19 illustrates the color image forming apparatus according to the present exemplary embodiment. Referring to FIG. 19, an image forming apparatus 190 forms an image using a plurality of colors of toners including yellow (Y), magenta (M), cyan (C), and black (Bk, hereinafter referred to as K). The image forming apparatus 190 is a tandem-type image forming apparatus. More specifically, the toner image is formed on a photosensitive member 191 at each image station corresponding to each color, and the toner images of each color are superposed on an intermediate transfer member 192 (belt member).

Further, the image forming apparatus 190 includes an exposure unit 193 (193Y, 193M, 193C, and 193K), a charging unit 194 (194Y, 194M, 194C, and 194K), and a developing unit 196 (196Y, 196M, 196C, and 196K) as the image forming unit. Furthermore, the image forming apparatus 190 includes the photosensitive member 191 (191Y, 191M, 191C, and 191K) and a cleaning apparatus 197 (197Y, 197M, 197C, and 197K).

The image forming process performed at each image station corresponding to each color is similar to the above-described exemplary embodiment, and description will be omitted. The toner image formed on the photosensitive member 191 of each color is then transferred to the intermediate transfer member 192 at the primary transfer unit.

Each color toner on the intermediate transfer member 191 is collectively transferred onto a recording medium P at a secondary transfer portion (T2). The toner image on the recording medium is then heat-fixed by a fixing device 198.

Figure 20:
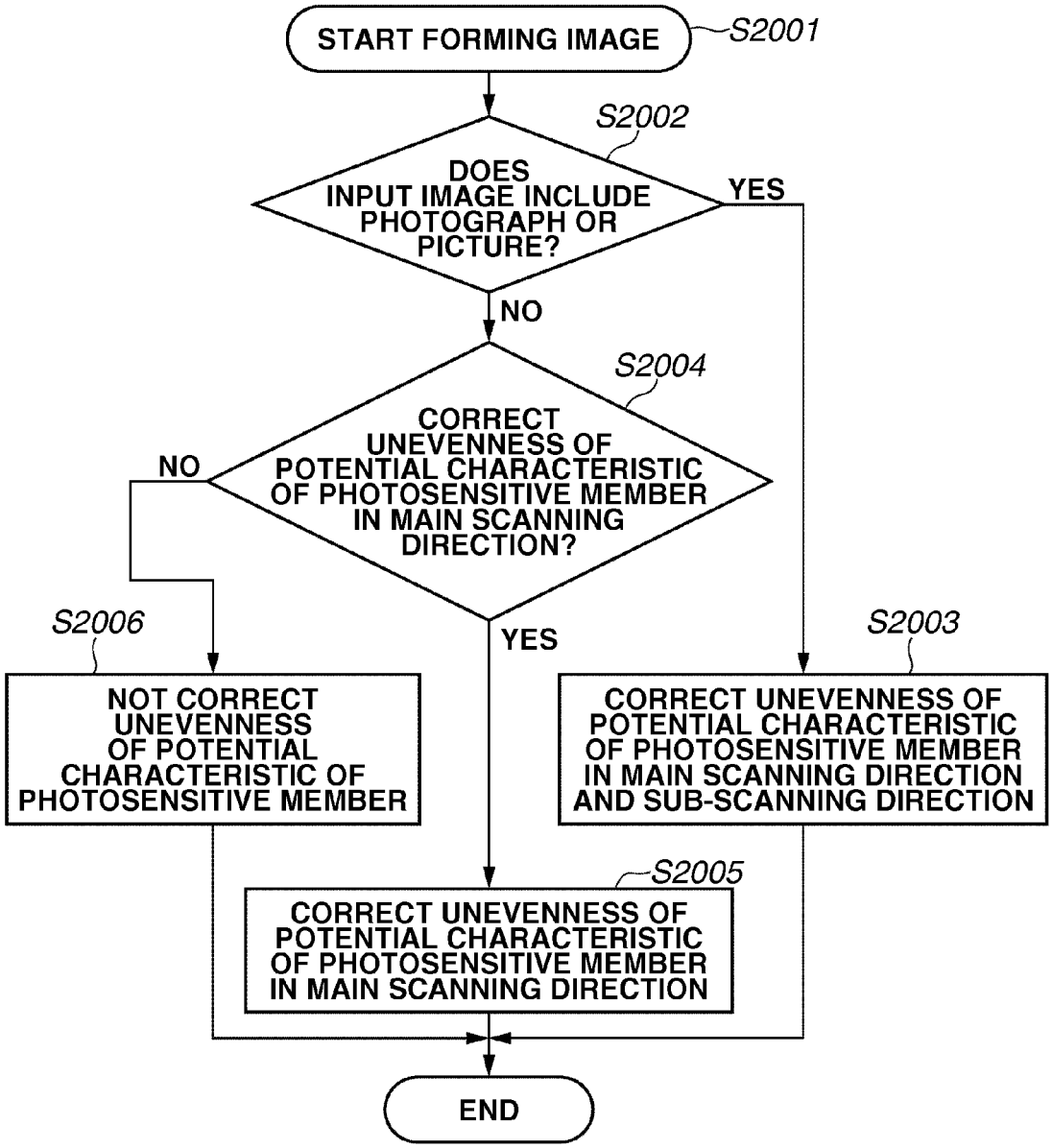
FIG. 20 is a flowchart illustrating a control process performed by the main control unit according to the fourth exemplary embodiment of the present invention.

FIG. 20 is a flowchart illustrating a control process performed by the main control unit 101 (illustrated in FIG. 4B) according to the present exemplary embodiment.

In step S2001, the main control unit 101 starts forming the image by receiving the image data from an image reading unit 199 or an external information processing apparatus. In step S2002, the main control unit 101 determines whether the input image includes a photograph or a picture.

If the main control unit 101 determines that the input image includes the photograph or the picture (YES in step S2002), the process proceeds to step S2003. In step S2003, the main control unit 101 corrects the unevenness of the potential characteristic of the photosensitive member in the main scanning direction and the sub-scanning direction. On the other hand, if the main control unit 101 determines that the input image does not include a photograph or a picture (NO in step S2002), the process proceeds to step S2004.

In step S2004, the main control unit 101 determines whether there is an instruction to correct the unevenness of the potential characteristic in the main scanning direction of the photosensitive member 1. The user designates whether to correct the unevenness of the potential characteristic in the main scanning direction of the photosensitive member 1 from the operation unit 104 or a screen of the external information processing apparatus such as a computer.

If there is the instruction to correct the unevenness of the potential characteristic in the main scanning direction of the photosensitive member 1 (YES in step S2004), the process proceeds to step S2005. In step S2005, the main control unit 101 forms the image while changing the exposure intensity of the exposure unit 3 to correct the unevenness of the potential characteristic in the main scanning direction.

On the other hand, if there is no instruction to correct the unevenness of the potential characteristic in the main scanning direction of the photosensitive member 1 (NO in step S2004), the process proceeds to step S2006. In step S2006 (i.e., not correct unevenness of potential characteristic of the photosensitive member), the main control unit 101 forms the image by causing the exposure unit 3 to expose the photosensitive member 1 using the above-described reference exposure intensity.

As described above, the unevenness of the potential characteristic is corrected when forming the image, which includes the photograph or the picture. When the image forming apparatus outputs a document or a monochrome image, the unevenness of the potential characteristic is not corrected at least in the sub-scanning direction. As a result, the density unevenness caused by the unevenness of the potential characteristic can be reduced when forming a high-quality image. Further, FCOT of the image, which does not require higher image quality than a photograph, such as a document, can be shortened.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-209966 filed Aug. 18, 2008 and No. 2009-166908 filed Jul. 15, 2009, which are hereby incorporated by reference herein in their entirety.

What is claimed is:

1. An image forming apparatus which forms an image on a recording medium in one of a first image forming mode and a second image forming mode to form an image with higher quality than quality of an image formed in the first image forming mode, the image forming apparatus comprising:

an image forming unit including a photosensitive member which is rotated by a driving unit and on which an electrostatic latent image is formed, and an exposure unit configured to expose the photosensitive member to form the electrostatic latent image, and to form an image by transferring to the recording medium a toner image acquired by developing the electrostatic latent image formed on the photosensitive member using toner;

a detection unit configured to detect that a reference position disposed on the photosensitive member has reached a predetermined position while the photosensitive member is rotating;

a storage unit configured to store correction data for correcting unevenness of potential characteristics of the photosensitive member; and a control unit configured to control an exposure intensity of the exposure unit at each position on the photosensitive member based on the correction data, wherein in a case in which the image forming unit forms an image in the first image forming mode, the control unit allows the exposure unit to start exposing the photosensitive member regardless of a detection of the reference position, wherein in a case in which the image forming unit forms an image in the second image forming mode, the control unit allows the exposure unit to start exposing the photosensitive member in response to a detection of the reference position, and controls the exposure intensity based on the correction data.

2. The image forming apparatus according to claim 1, further comprising a charging unit configured to charge the photosensitive member, wherein the storage unit stores the correction data, which is obtained based on unevenness of the potential characteristic at each position on the photosensitive member which is charged by the charging unit, or unevenness of the potential characteristic at each position on the photosensitive member.

3. The image forming apparatus according to claim 1, further comprising a determination unit configured to determine whether to add a specific image including minute dots to an image to be output, wherein the control unit controls, in a case in which a determination unit determines that the specific image is to be added to the image to be output, the image forming unit to form an image in the second image forming mode and controls an exposure intensity according to the exposed position.

4. The image forming apparatus according to claim 1, wherein the control unit includes an addition unit configured to add a watermark pattern to an image to be output, and controls, the image forming unit to form the image to be output in the second image forming mode.

5. The image forming apparatus according to claim 1, wherein the control unit includes an encryption unit configured to add an encryption image to an image to be output, and controls the image forming unit to form an image to be output in the second image forming mode.

6. The image forming apparatus according to claim 1, wherein the control unit controls, in a case in which an image forming unit forms an image in the first image forming mode, the exposure intensity at each position in a direction of a rotation shaft of the photosensitive member based on a mean of sensitivity in the rotation direction at each position in the direction of the rotation shaft.

7. The image forming apparatus according to claim 1, wherein the second image forming mode forms an image with higher resolution than resolution of an image formed in the first image forming mode.

8. A method for forming an image comprising:

forming the image on a recording medium in one of a first image forming mode and a second image forming mode to form an image with higher quality than quality of an image formed in the first image forming mode;

forming an electrostatic latent image on a photosensitive member which is rotated by a driving unit;

exposing the photosensitive member by an exposure unit to form the electrostatic latent image;

developing the electrostatic latent image using a toner;

detecting a reference position disposed on the photosensitive member that has reached a predetermined position while the photosensitive member is rotating;

storing correction data for correcting of potential characteristics of the photosensitive member; and controlling the exposure unit in such a manner that the exposure unit starts exposing the photosensitive member regardless of a detection of the reference position in a case in which the image is formed in the first image forming mode, and the exposure unit in such a manner that the exposure unit starts exposing in response to a detection of the reference position in a case in which the image is formed in the second image forming mode.

9. The method according to claim 8 further comprising:

charging the photosensitive member.

10. The method according to claim 8 further comprising:

determining whether to add a specific image including minute dots to an image to be output.

* * * * *